US012789033B2

(12) United States Patent
Brady

(10) Patent No.: US 12,789,033 B2
(45) Date of Patent: Nov. 10, 2026

(54) EXERCISE AND HYDRATION DEVICE AND METHODS OF USING SAME

(71) Applicant: Verra Industry LLC, Indian Hills, CO (US)

(72) Inventor: Jon Collin Brady, Indian Hills, CO (US)

(73) Assignee: Verra Industry LLC

( * ) Notice: Subject to any disclaimer, the term of this patent is extended or adjusted under 35 U.S.C. 154(b) by 97 days.

(21) Appl. No.: 18/734,171

(22) Filed: Jun. 5, 2024

(65) Prior Publication Data

US 2024/0408432 A1 Dec. 12, 2024

Related U.S. Application Data

(60) Provisional application No. 63/506,420, filed on Jun. 6, 2023.

(51) Int. Cl.

| | |
|---|---|
| ***A63B 21/06*** | (2006.01) |
| ***B65D 25/40*** | (2006.01) |
| ***B65D 47/12*** | (2006.01) |
| ***B65D 51/16*** | (2006.01) |

(52) U.S. Cl.

CPC ..... *A63B 21/0602* (2013.01); *B65D 25/40* (2013.01); *B65D 47/122* (2013.01); *B65D 51/1644* (2013.01); *A63B 2225/682* (2013.01)

(58) Field of Classification Search

CPC ..... A63B 21/0602; A63B 21/072; A63B 2225/682; A45B 3/00; A45B 3/08; B65D 25/40; B65D 47/122; B65D 51/1644

See application file for complete search history.

(56) References Cited

U.S. PATENT DOCUMENTS

| | | | | | |
|---|---|---|---|---|---|
| 255,299 | A * | 3/1882 | Keam | A45B 3/00 | 135/66 |
| 3,443,820 | A * | 5/1969 | Baker | A63C 11/2224 | 135/65 |
| 3,561,782 | A * | 2/1971 | Tyrack | A63C 11/2224 | 280/821 |
| 4,229,015 | A * | 10/1980 | Ramsey | A63C 11/222 | 135/66 |
| 4,351,348 | A * | 9/1982 | Axton | A45B 3/00 | 135/66 |
| 4,986,535 | A * | 1/1991 | Hull | A63B 21/0602 | 482/93 |

(Continued)

OTHER PUBLICATIONS

Whiski Poles, website, accessed May 28, 2024, <https://www.whiskipoles.com>.

*Primary Examiner* — Joshua Lee
(74) *Attorney, Agent, or Firm* — Laura Marmulstein

(57) ABSTRACT

The disclosed technology includes one or more exercise and hydration devices. In one example, an exercise and hydration device may include an elongated tubular body that has a first end and a second end. The elongated tubular body may define a cavity and the first end may define an aperture that allows access to the cavity. A cap may be coupled to the first end and may seal the aperture. A length of the exercise and hydration device may be defined between the first end and the second end. The cavity may be sized to carry an amount of a potable liquid that adds a weight to the exercise and hydration device that is desirable for upper body strength training by an average person.

20 Claims, 22 Drawing Sheets

(56) References Cited

U.S. PATENT DOCUMENTS 5,082,279 A * 1/1992 Hull ..... A63B 60/00 473/297
5,431,615 A * 7/1995 Correll ..... A63B 21/0602 446/267
5,452,889 A * 9/1995 Lewinski ..... A63B 59/50 473/519
5,580,321 A * 12/1996 Rennhack ..... A63B 15/00 482/109
6,539,965 B1 * 4/2003 White, III ..... A45B 3/08 135/65
6,745,785 B2 * 6/2004 Kotovsky ..... A45B 3/00 135/65
9,526,941 B2 * 12/2016 Wu ..... A63B 21/0728
9,877,888 B1 * 1/2018 Sosebee ..... A45B 9/02
10,172,427 B2 * 1/2019 D'Jay ..... B65D 23/001
10,610,738 B2 * 4/2020 Seeger ..... A63B 21/0004
10,772,398 B2 * 9/2020 Stringham ..... A45B 3/00
10,881,173 B1 * 1/2021 Stringham ..... A45B 9/02
11,097,146 B2 * 8/2021 Langston ..... A63B 59/56
11,110,314 B1 * 9/2021 Wineman ..... A63B 21/0724
11,285,350 B2 * 3/2022 Edeker ..... A63B 21/4035
11,382,394 B1 * 7/2022 Stringham ..... A45B 9/02
11,432,625 B1 * 9/2022 Freeman ..... A45B 9/02
11,638,849 B1 * 5/2023 Rimes ..... A63B 21/0724 482/106
2002/0072427 A1 * 6/2002 Chang ..... A63B 15/00 473/219
2004/0140311 A1 * 7/2004 Benat ..... B65D 81/3844 220/592.2
2004/0216775 A1 * 11/2004 Kotovsky ..... A45C 11/00 135/66
2006/0276270 A1 * 12/2006 Haney ..... A63B 59/52 473/457
2008/0023054 A1 * 1/2008 Kotovsky ..... A45B 3/00 206/217
2017/0001060 A1 * 1/2017 D'Alesio ..... A63B 21/0602
2017/0282001 A1 * 10/2017 Imbert ..... A63B 1/00

* cited by examiner

EXERCISE AND HYDRATION DEVICE AND METHODS OF USING SAME

CROSS REFERENCE TO RELATED APPLICATIONS

The present application claims the benefit of priority to U.S. Provisional Patent Application No. 63/506,420, entitled "EXERCISE AND HYDRATION DEVICE AND METHODS OF USING SAME," filed Jun. 6, 2023, the entirety of which is hereby incorporated by reference herein for all purposes.

TECHNICAL FIELD

The technology described herein relates generally to a device for exercise and hydration and methods of using the same.

BACKGROUND

Running, walking, and hiking are popular forms of aerobic or cardio exercise. Such activities target the lower body and cardiovascular system but typically fail to provide a full body workout that strengthens the upper body. Further, it can be difficult to carry water to hydrate while doing such activities. Water may be carried in a water bottle held in a user's hand or strapped to a user's waist, which can be cumbersome and may throw the user off balance or otherwise hinder performance.

The information included in this Background section of the specification, including any references cited herein and any description or discussion thereof, is included for technical reference purposes only and is not to be regarded subject matter by which the scope of the invention as defined in the claims is to be bound.

SUMMARY

The disclosed technology includes exercise and hydration devices and methods of using the same. Embodiments of the present disclosure may include an exercise and hydration device. The exercise and hydration device may include an elongated tubular body including a first end and a second end and a cap coupled to the first end. The elongated tubular body may define a cavity and the first end may define an aperture that provides access to the cavity. A length of the exercise and hydration device may be defined between the first end and the second end. The cap may seal the aperture. The cavity may be sized to carry an amount of a potable liquid that adds a weight to the exercise and hydration device that is desirable for upper body strength training by an average person. The weight may be greater than 0.5 lbs.

Other examples or embodiments of the present disclosure may include an exercise and hydration device that includes a tubular body forming a ring shape and defining a cavity, wherein the ring shape defines an opening having a diameter; an aperture defined within a surface of the tubular body to provide access to the cavity; and a cap sealing the aperture. The cavity may be sized to carry an amount of a potable liquid that adds a weight to the exercise and hydration device that is desirable for upper body strength training.

Further examples or embodiments of the present disclosure may include a method of using an exercise and hydration device. The method may include obtaining one or more exercise and hydration devices, wherein the one or more exercise and hydration devices include an elongated tubular body having a first end and a second end defining a length therebetween, wherein the length is greater than 1 foot. A cavity may be defined within the elongated tubular body, an aperture may be defined in the elongated tubular body at the first end to access the cavity, and a cap may seal the aperture. The method may further include removing the cap from the aperture, pouring a potable liquid through the aperture to at least partially fill the cavity with the potable liquid, and moving with the one or more exercise and hydration devices in one or both of a user's hands to engage the user's upper body during a cardio exercise.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments and implementations and illustrated in the accompanying drawings.

DETAILED DESCRIPTION

Figure 1:
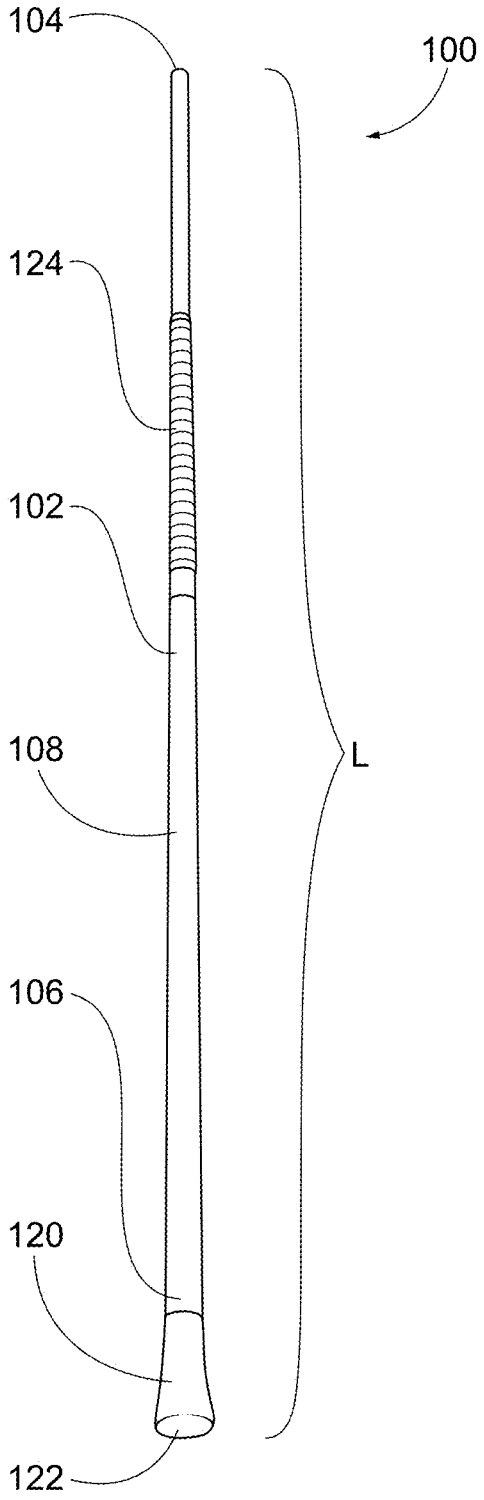
FIG. 1 is a bottom isometric view of a first embodiment of an exercise and hydration device.

This disclosure is related to exercise and hydration devices and methods. The disclosed exercise and hydration devices and methods enable a user or pedestrian (e.g., a walker, runner, hiker, or the like) to activate the user's upper body during a cardio or aerobic exercise, such as a walk, run, hike, or the like, thereby achieving a more effective full body workout. Disclosed exercise and hydration devices may include a tubular body that defines a cavity or lumen and an aperture defined within the tubular body and that provides access to the cavity or lumen. The aperture may be sealed by a cap. A liquid, such as water, may be included inside the cavity and accessed through the aperture when the cap is removed. Including liquid within the cavity may add weight to disclosed exercise and hydration devices to increase upper body strength training and/or dynamic stretching during a cardio workout, while simultaneously providing the user with a means to hydrate during the cardio workout. For example, added liquid may add more than 0.4 lbs. or 0.5 lbs. of weight to the exercise and hydration device. For example, added liquid may add between about 1 lb. to about 2 lbs. or more of weight to the exercise and hydration device. Disclosed exercise and hydration devices may include one or more grips coupled to the tubular body to facilitate a user holding the tubular body as the user moves.

In several embodiments, disclosed exercise and hydration devices may be used by a user as the user walks, runs, hikes, or the like, to exercise and dynamically stretch the user's upper body. Disclosed exercise and hydration devices may dynamically stretch a user's body by providing an additional weight that pushes the user's body part(s) (e.g., torso, arm, shoulder, etc.) beyond the point it would normally stretch. For example, as a user turns his or her torso, the torso may stop at its maximum rotation position while the kinetic movement of a disclosed exercise and hydration device may continue to turn the user's torso an additional amount to provide the additional stretch that would not otherwise be available by merely turning the torso. Disclosed exercise and hydration devices may provide a user with improved stability as the user travels or moves over various terrain. Disclosed exercise and hydration devices may improve a user's gait and/or lower a user's center of gravity for more effective body mechanics and ergonomics. Such alterations in a user's positioning provided by disclosed exercise and hydration devices may be beneficial for long distance runners.

Dynamic movements with disclosed exercise and hydration devices may be varied to target different upper body muscles and stretch and/or strengthen the same. Exemplary positionings of disclosed exercise and hydration devices relative to the user's body include over one or both shoulders, extended above a user's head (e.g., with arms extended or slightly bent), extended in front of a user (e.g., with arms extended or slightly bent), to a side of a user (e.g., held in one or both hands), and extended behind a user (e.g., with one or both arms positioned behind the user). With the one or more disclosed exercise and hydration devices held by a user, the user may keep the user's body positioned forward or twist at the torso (e.g., to activate or stretch core and/or back muscles) as the user moves. Disclosed exercise and hydration devices may be held at a center point, off center, at an end, at both ends, at opposing sides, and the like. For example, when a disclosed exercise and hydration device is held at an end, the exercise and hydration device acts as a cantilevered weight.

The disclosed exercise and hydration devices may also be used by the user to hydrate. Disclosed exercise and hydration devices may include a cavity or lumen that can be filled with liquid (e.g., water). The liquid may be readily accessible by a removable cap or adjustable valve. With an easy-to-remove cap or easy-to-open valve, the liquid stored inside a disclosed exercise and hydration devices may be readily consumed, e.g., during the cardio workout without the need to stop. The liquid may provide the additional benefit of adding weight to the disclosed exercise and hydration device to increase strength training. Disclosed exercise and hydration devices provide an improvement over water bottles that may be carried as a user walks, runs, or hikes, as the disclosed exercise and hydration devices allow water to be carried away from the user's body and a similar volume of water to be spread out over a larger footprint or area. Such attributes of disclosed exercise and hydration devices may prevent the extreme jostling movements often created by a water bottle held or attached to a user in an isolated area.

Typically when people perform cardio exercise, they naturally swing their arms next to their bodies to reduce angular momentum and balance rotational motion. Some people may carry small weights in their hands as they run or walk to include some upper body strength training; however, such weights do not carry water for hydration and do not change in weight over the course of the run or walk. Further, such weights do not allow for dynamic stretching of the upper body, but are merely used for strengthening purposes. Such weights are typically held in a user's hands as the user runs or walks and track the user's normal arm swinging that occurs during running or walking. The weights are not designed to be easily held in a position that activates the user's core or back muscles (e.g., deltoids or trapezius).

Disclosed exercise and hydration devices provide weight for strength training and are shaped to allow for dynamic stretching during a cardio workout. When water or another potable liquid is included inside the cavity of a disclosed exercise and hydration device, additional weight is added during a cardio workout. The weight and/or balance of the disclosed exercise and hydration device may be varied as the potable liquid is consumed for hydration. Decreasing weight throughout the course of a cardio workout may be desirable as the user gets tired. The design of a disclosed exercise and hydration device may thereby encourage hydration, as the user may be motivated to drink more liquid to decrease the weight of the disclosed exercise and hydration device. The added weight and movement of the liquid inside disclosed exercise and hydration devices may create a rhythm-setting kinetic movement to assist in arm swinging as the user moves. When a disclosed exercise and hydration device is filled partially with a liquid, the liquid may be positioned in one end of the device as a user swings the device, allowing for dynamic stretching as the liquid provides a weight a distance (e.g., 4-5 feet) away from the user's center of gravity. The liquid may remain at one end by centripetal force when a disclosed exercise and hydration device is spun around a user's center of gravity.

Figure 2:
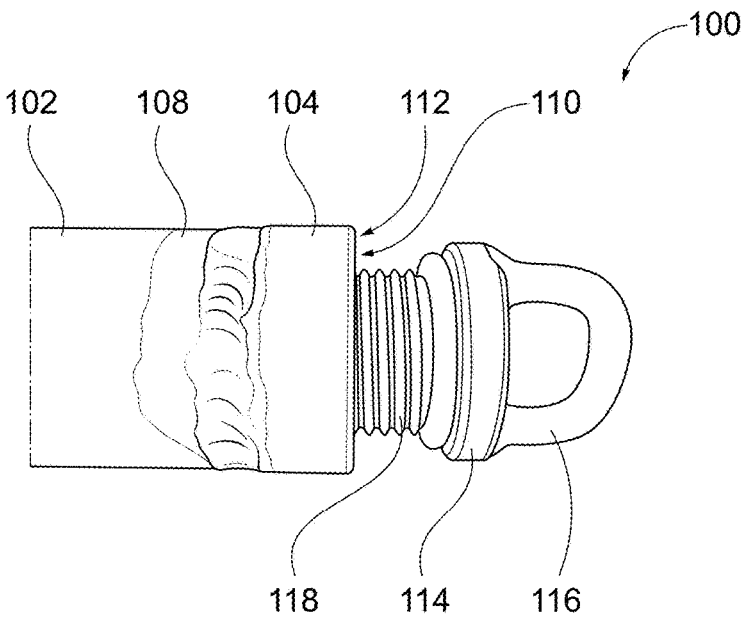
FIG. 2 is an isolated zoomed in view of a first end of the exercise and hydration device of FIG. 1.
Figure 3:
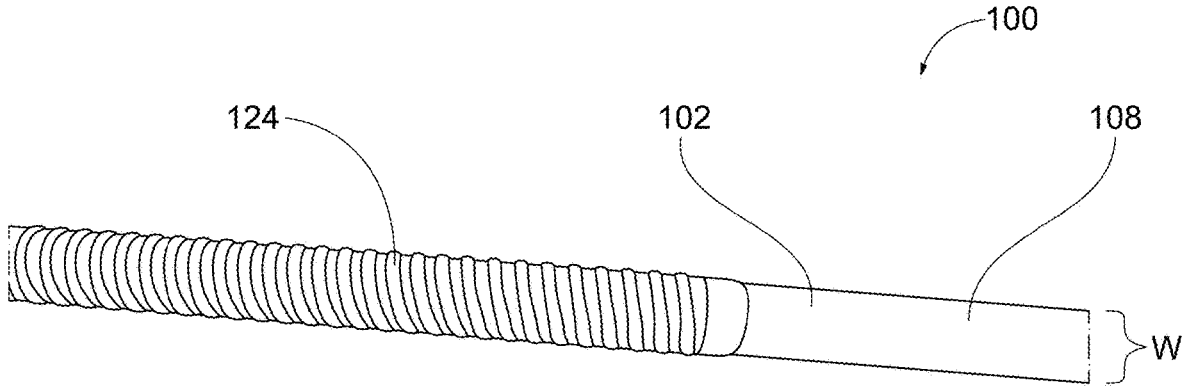
FIG. 3 is an isolated zoomed in view of a hand grip of the exercise and hydration device of FIG. 1.
Figure 4:
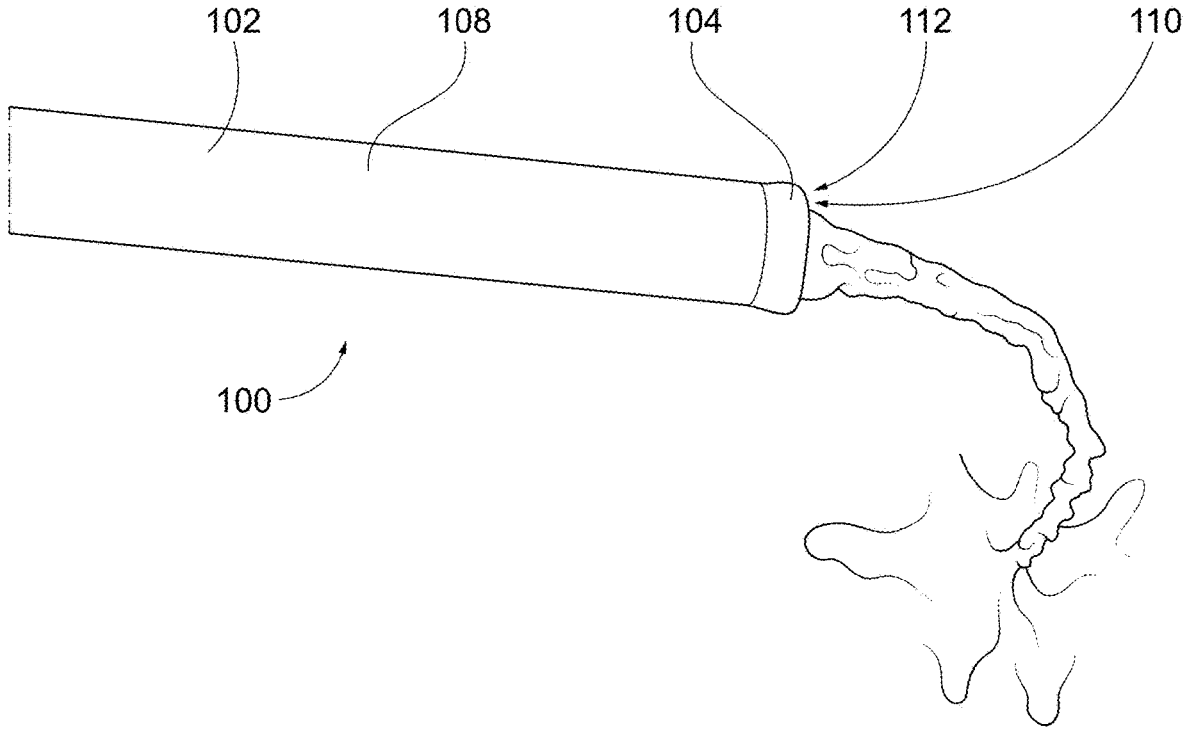
FIG. 4 is an isolated zoomed in view of the first end of the exercise and hydration device of FIG. 1 with the cap removed.

Turning to the figures, exercise and hydration devices and methods embodiments of the present disclosure will now be discussed in more detail. FIG. 1 is a bottom isometric view of a first embodiment of an exercise and hydration device. FIG. 2 is an isolated zoomed in view of a first end of the exercise and hydration device of FIG. 1. FIG. 3 is an isolated zoomed in view of a hand grip of the exercise and hydration device of FIG. 1. FIG. 4 is an isolated zoomed in view of the first end of the exercise and hydration device of FIG. 1 with the cap removed. As shown, the exercise and hydration device 100 may include a tubular body 102. The tubular body 102 may include a first end 104 and a second end 106. As shown, the tubular body 102 has an elongated tubular shape. For example, the tubular body 102 may be formed by a hollow pipe, tube, or the like. The tubular body 102 may include a rigid material, such as copper, stainless steel, double wall vacuum stainless steel, carbon fiber, and the like. For example, copper may add harmless and/or beneficial minerals to the liquid. In some embodiments, the tubular body 102 may include a non-rigid or flexible material, such as rubber, plastic, and the like. The tubular body 102 may be insulated to maintain a temperature of a liquid stored inside the exercise and hydration device 100.

The tubular body 102 has a length L and a width W. The length L may be desirable for providing balance and/or dynamic stretching as a user moves or performs a cardio workout. For example, the length L may be between about 48 inches and about 74 inches. As one example, the length L is approximately 6 ft. (e.g., a couple millimeters, centimeters, or inches off). The length L may be adjusted or modified based on a user's height and/or weight. For example, the length L may be about 80% to about 110% or more of a user's height. In some embodiments, it is desirable to modify the length L to accommodate a user's height and/or weight for improved balance and/or optimal weight training based on the user's height and/or weight. The width W may be desirable for facilitating a user gripping around the tubular body 102 such that the grip is secure as the user moves. For example, the width W may be sized to fit inside the palm of an average female or male hand. The user may extend the user's fingers around the width W such that the user's fingers touch. For example, the width W may be between about 0.75 inches to about 1.75 inches. As one example, the width W is about 1 inch in diameter, for example, 1.25 inches in diameter. The dimension of the length L may be more than 20 times greater than the dimension of the width W, for example, at least 50, 60, 70, 80 times greater than the width W. The width W may be uniform along a length L of the tubular body 102. For example, the width W may be uniform along greater than 50%, greater than 75%, greater than 90%, or 100% of the length L of the tubular body 102. By incorporating a uniform, non-tapered width W along a majority or entirety of the length L of the tubular body 102, weight may be distributed more evenly throughout the tubular body 102. This even weight distribution may be desirable for the purpose of the exercise and hydration device 100 to allow for dynamic stretching and/or strength training.

The tubular body 102 may have a tubular body wall 108. The tubular body wall 108 may have a thickness that is based on a desired weight of the exercise and hydration device 100. The thickness of the tubular body wall 108 may be adjusted based on the desired weight of the exercise and hydration device 100. For example, a thinner tubular body wall 108 may provide less weight to the exercise and hydration device 100. For example, the tubular body wall 108 may have a thickness between about 0.020 inches to about 0.080 inches or more. The desired thickness may also depend on the material of the exercise and hydration device 100. The weight of the exercise and hydration device 100 may be varied. As an example, the weight may be greater than 1 pound. For example, the weight may be between about 2 pounds to about 8 pounds or more.

The tubular body 102 or tubular body wall 108 may define a cavity or lumen 110. The cavity 110 may extend along the length L of the tubular body 102 or along a portion of the length L of the tubular body 102. In embodiments where the cavity 110 extends along a portion of the length L, a separate cavity or compartment may be included at one end of the tubular body 102 for use as a storage compartment (e.g., to store survival items such as matches, an emergency blanket, a compass, etc.). As shown in FIG. 4, the cavity 110 may store a potable liquid, such as water. The cavity 110 may store a volume of liquid that is similar to a volume of liquid stored in an average water bottle for adequate hydration during exercise. For example, the cavity 110 may store between 25 to 32 ounces of liquid. As one example, the cavity 110 may store 1 quart of liquid. When the cavity 110 is full, the exercise and hydration device 100 may weigh between about 2 lbs. to about 5 lbs.

It is contemplated that a mixer may be included inside the cavity 110 to mix the liquid, e.g., to mix a powder such as a hydration powder or protein powder in the liquid. The mixer may have a shape that is spherical, cylindrical, tubular, or the like, and may be sized to fit inside the cavity 110 and move up and down the length L or a portion of the length L of the tubular body 102. The shape and size of the mixer may account for the movement of the liquid inside the cavity 110. For example, liquid may move as the tubular body 102 is tipped back and forth. Air inside the cavity 110 may result in bubbling of the liquid thereby slowing its movement through the cavity 110. The shape of the mixer may account for this particular movement inside the cavity 110. The mixer may be porous to allow liquid to pass therethrough to mix the liquid. For example, the mixer may include wires or apertures defined throughout the mixer body. It is contemplated that the mixer may be contained in a separate compartment within the cavity 110 such that the mixer travels along a portion of a length of the cavity 110.

The first end 104 of the tubular body 102 may define an aperture 112. The aperture 112 may provide access to the cavity 110. The aperture 112 may be sealed by a cap 114. In the depicted embodiment, the cap 114 is a screw cap that includes a loop 116 and a threaded insert 118. The loop 116 may facilitate removal of the cap 114 from the exercise and hydration device 100 and may facilitate a user holding the cap 114 as the user drinks from the exercise and hydration device 100. In some embodiments, the loop 116 may be omitted. The threaded insert 118 may be positioned inside the aperture 112. The tubular body wall 108 may include threading on an inside surface to receive the threading of the threaded insert 118 and secure the cap 114 to the exercise and hydration device 100, preventing any liquid stored inside the cavity 110 from leaking out of the exercise and hydration device 100.

While a screw cap is depicted, it is contemplated that the cap 114 may omit the threading and fasten to the exercise and hydration device 100 by alternative means. For example, the cap 114 may snap on or pop off of the exercise and hydration device 100 to facilitate quick removal of the cap 114 from the exercise and hydration device 100. For example, the cap 114 may be a plastic or rubber seal or cover that shapes around the tubular body wall 108 or plugs inside the aperture 112 to seal the aperture 112. The cap 114 may be attached to the tubular body 102 by an attachment (e.g., that wraps around an outer surface of the tubular body wall 108). In this manner, the cap 114 may be removed but remain coupled to the tubular body 102 to avoid losing the cap 114 while in motion.

In some embodiments, the cap 114 may be omitted. For example, a valve may be included at the first end 104. The valve may provide selective access to liquid stored inside the cavity 110. As an example, the valve may be opened by a user squeezing a mouthpiece (e.g., with the user's teeth). The valve may be closed by the user releasing the mouthpiece. Including a valve at the first end 104 may facilitate quick access to liquid stored inside the cavity 110, which may be desirable while a user is in motion. In some embodiments, the valve may be coupled to the cap 114.

The second end 106 of the tubular body 102 may include a cover, cap, or base 120. In the depicted embodiment, the base 120 has a flat end 122; however, other shapes are contemplated. The base 120 is coupled to the tubular body 102. The base 120 may have a base aperture at an end opposite the flat end 122 that receives the tubular body 102. Alternatively, a portion of the base 120 may be inserted inside the cavity 110 of the tubular body 102. The base 120 may be coupled to the tubular body 102 by threading or other fastening means. For example, the base 120 may be fastened to the tubular body 102 by adhesive, collared quick connect, sleeve coupling, a coarse threaded connection, or the like.

In some embodiments, the base 120 is removable. Different base shapes and features may be coupled to the tubular body 102 with varying functionality. For example, a rubber base (or other flexible material) may be coupled to the tubular body 102 to reduce impact of the base striking the ground. As another example, a base including a spike may be coupled to the tubular body 102 (e.g., to improve balance on ice). The spike may be used for defense. As yet another example, a base may include a storage compartment for storing items (e.g., matches, keys, etc.). As another example, the base may include a weight. The weight may be adjustable by adding different bases having different weights. It is contemplated that the second end 106 may be identical to the first end 104 and include a cap 114 or valve to provide a second access point to the cavity 110. It is contemplated that the base 120 may be made of a flexible material (e.g., to absorb forces when the base 120 contacts the ground). For example, the base 120 may be made of rubber or a durable plastic.

The exercise and hydration device 100 may include a grip 124. The grip 124 may extend a length of the length L of the tubular body 102. As an example, the grip 124 may extend ⅙ of the length L (e.g., 1 ft. long) or ⅓ of the length L (e.g., 2 ft. long) or some other length of the length L. In the depicted embodiment, the grip 124 is positioned at a center point of the tubular body 102. Such positioning may allow a user to grab the tubular body 102 at the center for improved balance while holding the exercise and hydration device 100. The length of the grip 124 may be such to allow a user to hold the tubular body 102 at different points outside of the center point. It is contemplated that the grip 124 may be positioned at different locations along the tubular body 102, such as, at the first or second ends 104, 106, respectively. It is contemplated that more than one grip 124 may be included. For example, the exercise and hydration device 100 may include grips on the first and second ends 104, 106 in addition to or as an alternative to the grip 124 at the center. The grip 124 may be made of a non-slip and flexible material. For example, the grip 124 may include rubber.

Other features may be coupled to the tubular body 102, e.g., for survival, navigational assistance, or added impact on fitness/exercise or hydration. As one example, a compass may be coupled to an outer surface of the tubular body 102 for a user to navigate his or her route while exercising. As another example, the tubular body 102 may include a flag attachment (e.g., a plurality of eyelets or grommets) to attach a flag or other wind resistant material or component to the tubular body 102. The flag or wind resistant component may add wind resistance to the exercise and hydration device 100, which may create a dynamic force that enhances the full body workout achieved using the exercise and hydration device 100. In some embodiments, the cavity 110 may extend through a portion of the length L of the tubular body 102. In these embodiments, the flag attachment may be coupled to another portion of the tubular body 102. In this manner, the weight of liquid stored in the cavity 110 may be counterbalanced by the flag attachment in a unique manner that provides more dynamic stretching and/or strength training when the exercise and hydration device 100 is in use.

In some embodiments, the tubular body 102 may include a fluid gauge to monitor the liquid level or amount inside the cavity 110. For example, the tubular body 102 may include a transparent strip (e.g., a glass or plastic strip) along a portion or the entirety of the length L. In some embodiments, a plurality of transparent strips are placed at intervals along the length L, for example, at 25%, 50%, and 75% of the length L. In this manner, the user may see the location and level of liquid inside the cavity 110.

Figure 5:
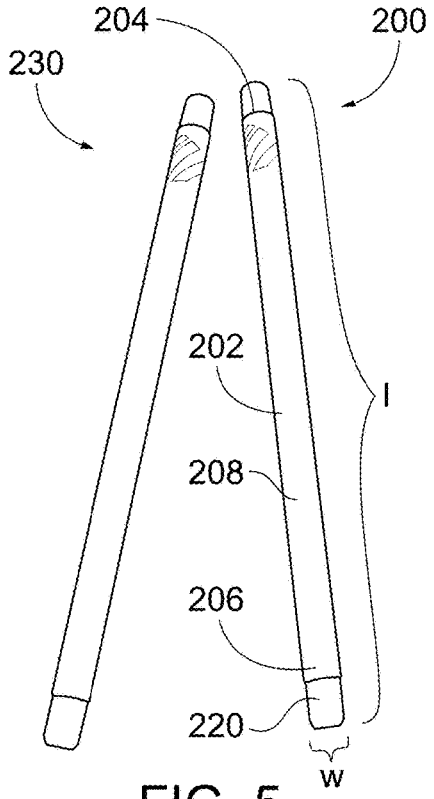
FIG. 5 is a front isometric view of a second embodiment of an exercise and hydration device.
Figure 6:
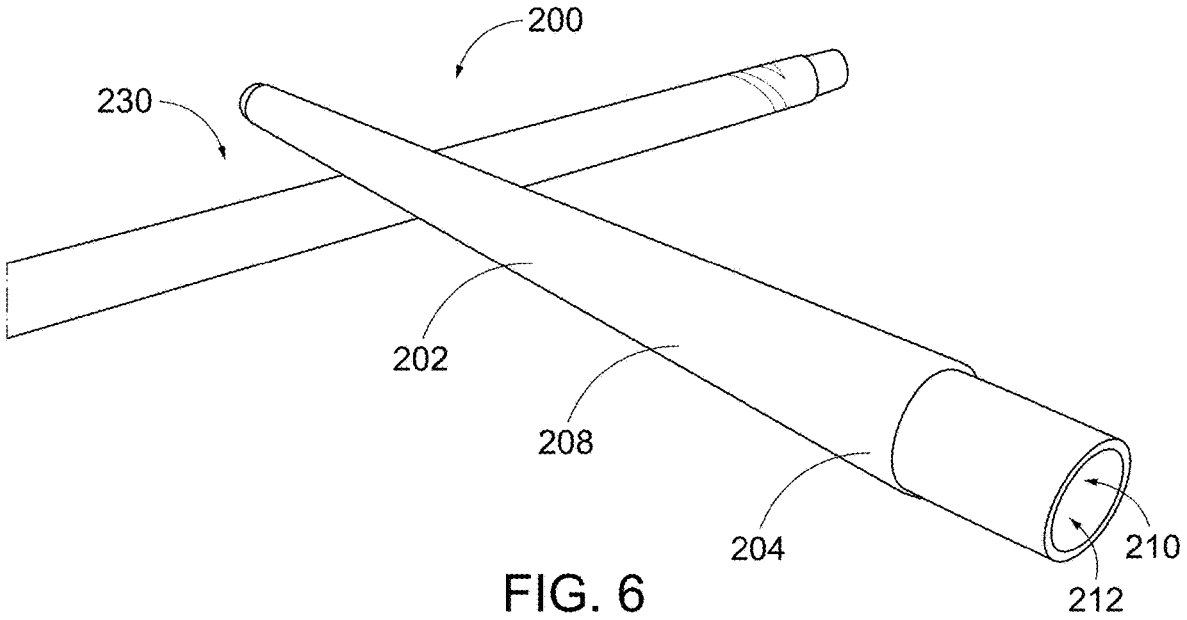
FIG. 6 is a top isometric view of the exercise and hydration device of FIG. 5.

FIG. 5 is a front isometric view of a second embodiment of an exercise and hydration device. FIG. 6 is a top isometric view of the exercise and hydration device of FIG. 5. The exercise and hydration device 200 depicted in FIGS. 5-6 may have similar or identical features as those described with respect to the exercise and hydration device 100 of FIGS. 1-4. As shown, the exercise and hydration device 200 includes a tubular body 202. The tubular body 202 may include a first end 204 and a second end 206. The tubular body 202 has a length 1 and a width w. The length 1 is shorter than the length L of the exercise and hydration device 100. The length l is longer than traditional handheld weights or a traditional water bottle to improve resistance to kinetic motion of the user. For example the length l may be greater than 1 ft., greater than 1.5 ft., greater than 2 ft, etc. The length 1 may be desirable for providing balance and/or dynamic stretching as a user moves or performs a cardio workout. For example, the length l may be between about 16 inches to about 32 inches or more. The width w may be desirable for facilitating a user gripping around the tubular body 202. For example, the width w may be sized to fit inside the palm of an average female or male hand.

The tubular body 202 may have a tubular body wall 208. The tubular body wall 208 may have a thickness that is based on a desired weight of the exercise and hydration device 200, in a similar manner as described above with respect to the exercise and hydration device 100. For example, the tubular body wall 208 may have a thickness between about 0.02 inches to about 0.08 inches or more. The weight of the exercise and hydration device 200 may be less than the weight of the exercise and hydration device 100, as the exercise and hydration device 200 is smaller than the exercise and hydration device 100 and may be used with a second exercise and hydration device 200.

The tubular body 202 or tubular body wall 208 may define a cavity or lumen 210. The cavity 210 may extend along the length 1 of the tubular body 202 or along a portion of the length 1 of the tubular body 202. The cavity 210 may store a liquid, such as water, in a similar manner as the cavity 110 of the exercise and hydration device 100 described above.

The first end 204 of the tubular body 202 may define an aperture 212. The aperture 212 may provide access to the cavity 210. The aperture 212 may be sealed by a cap (not shown). The cap may be similar to one of the caps 114, 960 described with respect to the exercise and hydration devices 100, 950 of FIGS. 1-4 and 14, respectively. The cap may be a screw cap or a cap that snaps on or pops off or the cap may be omitted. For example, a valve may be included at the first end 204.

The second end 206 of the tubular body 202 may include a cover, cap, or base 220 similar to those described with respect to the exercise and hydration device 100. For example, the base 220 may be flat, removable, may include a spike, may include a storage compartment, and the like. While a grip is omitted in the depicted embodiment, a grip may also be included similar to the grips described with respect to the exercise and hydration device 100. For example, a grip may be positioned on one or both of the first and second ends 204, 206.

As shown, the exercise and hydration device 200 may be part of an exercise and hydration device set 230 that includes two exercise and hydration devices 200. The two the exercise and hydration devices 200 may both be held by a user (one in each hand) as the user performs a cardio exercise, as described in more detail below. By using the exercise and hydration device set 230, a user may evenly apply upper body strength training to both arms.

Figure 7:
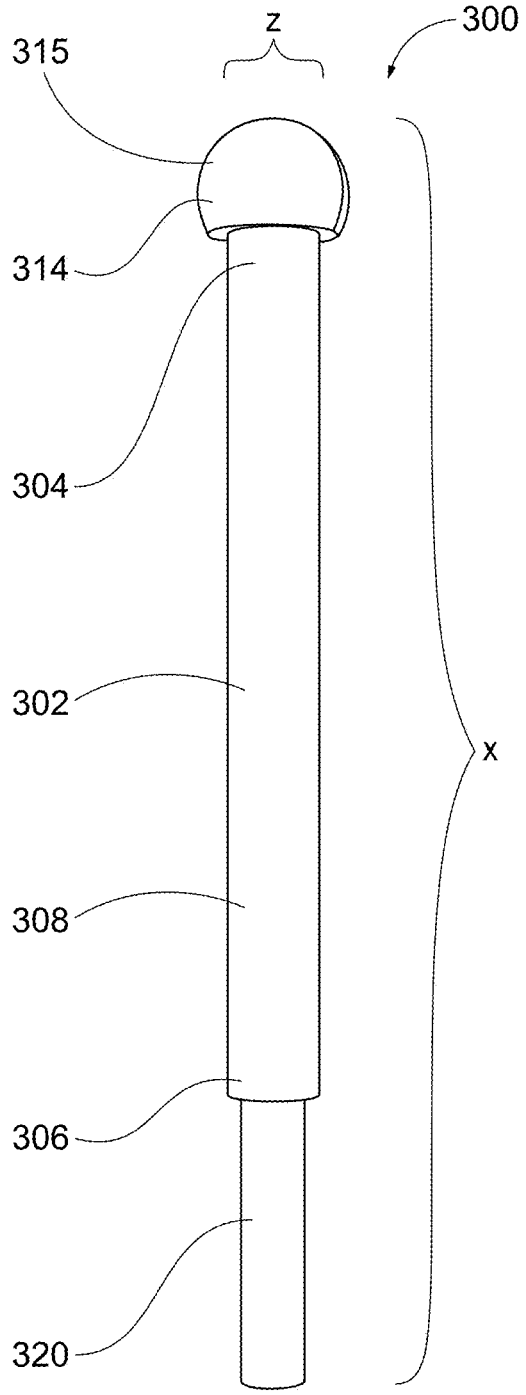
FIG. 7 is a front elevation view of a third embodiment of an exercise and hydration device.

FIG. 7 is a front view of a third embodiment of an exercise and hydration device. The exercise and hydration device 300 depicted in FIG. 7 may have similar or identical features as those described with respect to the exercise and hydration device 100 of FIGS. 1-4 and/or the exercise and hydration device 200 of FIGS. 5-6. For example, the exercise and hydration device 300 may include a tubular body 302 having a first end 304 and a second end 306. The tubular body 302 may define a first and second cavity. The first cavity may be filled partially or fully with a liquid. The first end 304 of the tubular body 302 may define an aperture. The aperture may provide access to the first cavity. The aperture may be sealed by a cap 314. The cap 314 may be similar to the cap 114 and cap 214 described with respect to the exercise and hydration devices 100, 200, respectively. In the depicted embodiment, the cap 314 has a rounded side 315, providing an ergonomic grip. It is contemplated that the cap 314 may have a T-shaped or T-shaped body, which facilitates a user grabbing the cap 314 from above such that the user's wrist is parallel to or linear with the tubular body 302.

The exercise and hydration device 300 has a length x and the tubular body 302 has a width z. The length x may be the same length or shorter than the length 1 of the exercise and hydration device 200. The width z may be desirable for facilitating a user gripping around the tubular body 302. For example, the width z may be sized to fit inside the palm of an average female or male hand.

The second end 306 of the tubular body 302 may be coupled to a base 320. In the depicted embodiment, the base 320 is slidably coupled to the tubular body 302. As shown, the base 320 is positioned partially inside the second cavity of the tubular body 302. The positioning of the base 320 inside the second cavity of the tubular body 302 may be varied to adjust the length x of the exercise and hydration device 300. For example, the base 320 may be positioned further inside or, in some embodiments, fully inside the second cavity to shorten the length x of the exercise and hydration device 300. The base 320 may be pulled further out of the second cavity to lengthen the length x of the exercise and hydration device 300. By including a telescoping base 320, the length x of the exercise and hydration device 300 is adjustable. While the embodiment depicted shows the base 320 positioned inside the tubular body 302, it is contemplated that the base 320 may include an aperture and a cavity and the tubular body 302 may be positioned inside the aperture and cavity of the base 320. In these embodiments, the second cavity may be omitted and the tubular body 302 may include a single cavity that extends along the length of the tubular body 302 (e.g., as described with respect to the tubular bodies 102 and 202 of the exercise and hydration devices 100, 200, respectively). The tubular body 302 may be positioned further inside the base 320 cavity to shorten the length x of the exercise and hydration device 300 or pulled out further from the base 320 cavity to lengthen or extend the length x of the exercise and hydration device 300. It is contemplated that the exercise and hydration device 300 may be included in a set of two exercise and hydration devices 300 in a similar manner as described with respect to the exercise and hydration device set 230 of FIGS. 5-6.

Figure 8:
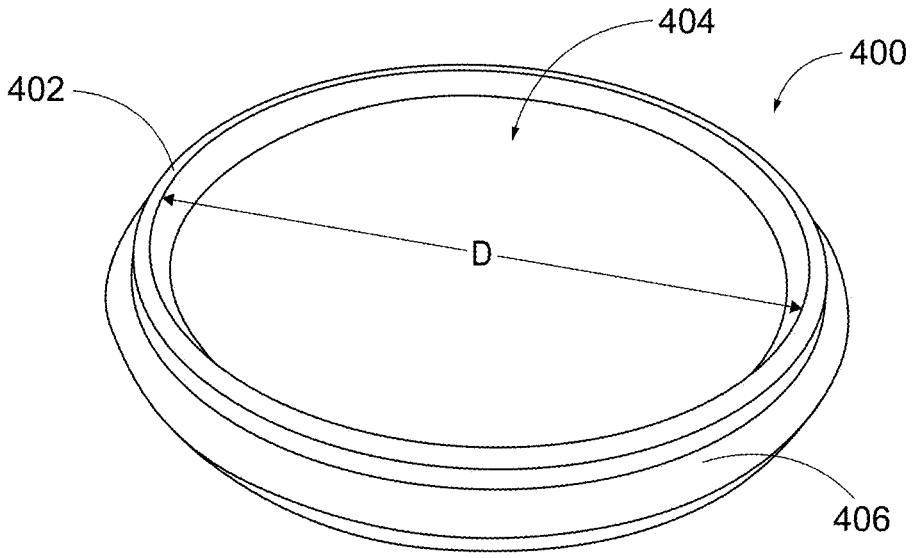
FIG. 8 is a top isometric view of a fourth embodiment of an exercise and hydration device.
Figure 9:
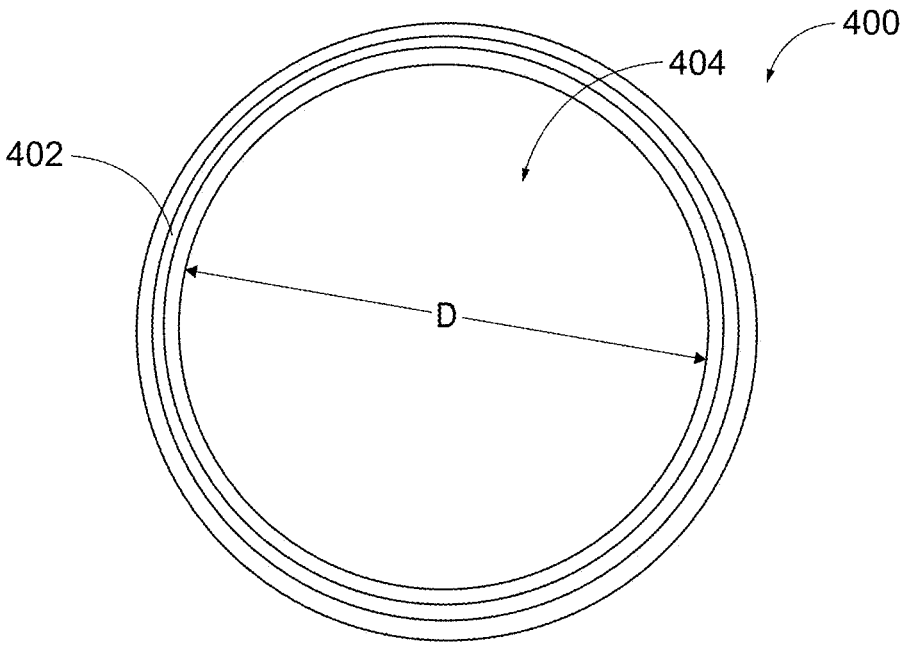
FIG. 9 is a top plan view of the exercise and hydration device of FIG. 8.

FIG. 8 is a top isometric view of a fourth embodiment of an exercise and hydration device. FIG. 9 is a top plan view of the exercise and hydration device of FIG. 8. The exercise and hydration device 400 includes a tubular body 402. The tubular body 402 forms a ring shape that defines an opening 404 in the center. The tubular body 402 may include a groove 406. The groove 406 may facilitate a user gripping the tubular body 402. The groove 406 may be omitted. It is contemplated that the exercise and hydration device 400 may include one or more grips to facilitate a user gripping the tubular body 402.

The tubular body 402 may define a cavity. An aperture may be defined within a surface of the tubular body 402 to provide access to the cavity. The cavity may store liquid in a similar manner as described with respect to the cavity 110 of the exercise and hydration device 100. A cap or seal may be positioned over the aperture to prevent the liquid inside the cavity from leaking. The cap may be similar to the cap 114 described with respect to the exercise and hydration device 100.

The exercise and hydration device 400 may have a diameter D that is sized based on average proportions of a user. For example, the diameter D may be sized such that opposing sides of the tubular body 402 are spaced approximately shoulder distance or greater than shoulder distance of an average female or male. As another example, the diameter D may be sized such that a user's head, neck, and at least one shoulder and arm can fit through the opening 404. For example, the diameter D may be between about 16 inches to about 40 inches or more.

Figure 10:
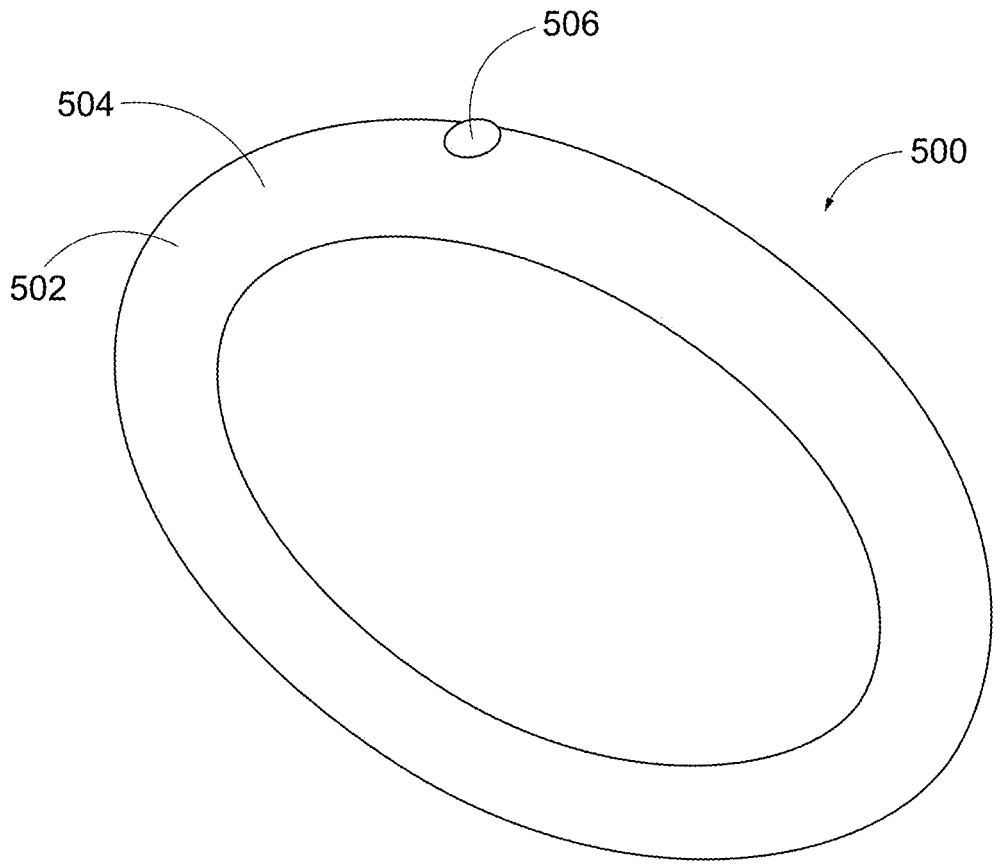
FIG. 10 is a top isometric view of a fifth embodiment of an exercise and hydration device.

FIG. 10 is a top isometric view of a fifth embodiment of an exercise and hydration device. The exercise and hydration device 500 may include similar or identical features as the exercise and hydration device 400 described with respect to FIGS. 8-9; however, the groove is omitted. As shown, the exercise and hydration device 500 includes a tubular body 502 that defines a cavity. An aperture is defined on an outer surface 504 of the tubular body 502. The aperture may provide access to the cavity (e.g., to liquid stored therein). As shown, the aperture is sealed by a plug cap 506. The plug cap 506 depicted is flush with the outer surface 504.

Figure 11:
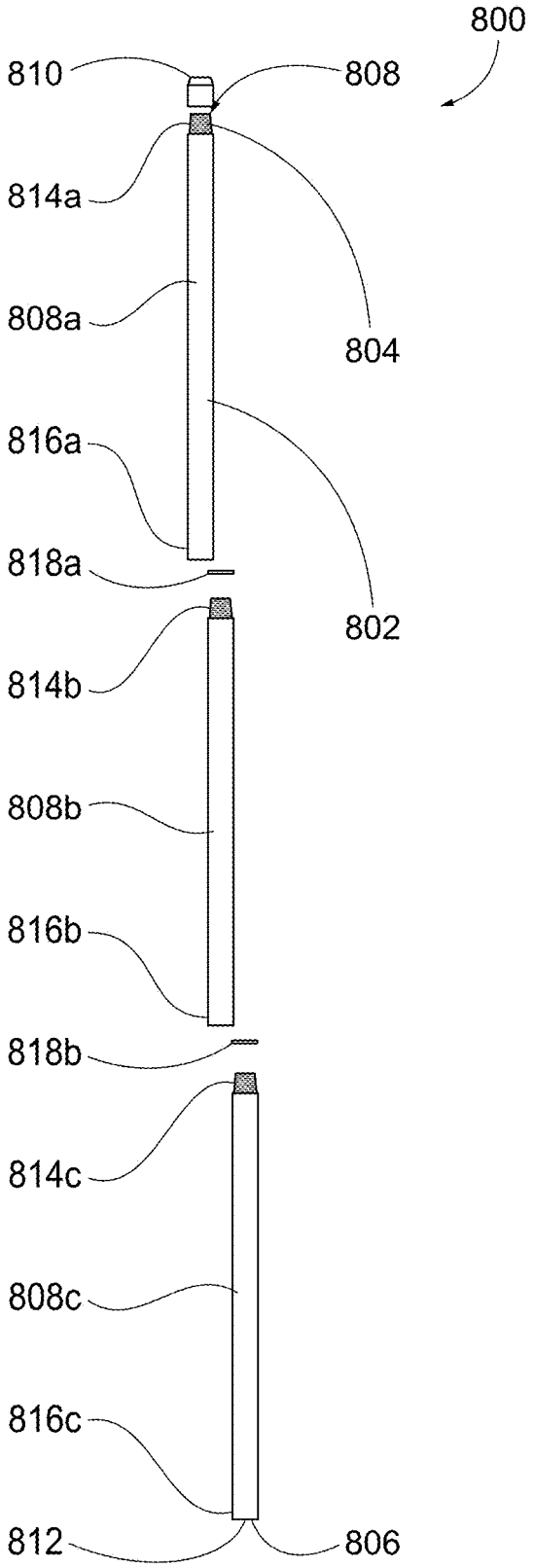
FIG. 11 is a front elevation view of another embodiment of an exercise and hydration device.

In some embodiments, disclosed exercise and hydration devices may be compactible for ease of portability or travel. FIG. 11 is a front elevation view of an exemplary embodiment of a compactible exercise and hydration device 800. The compactible exercise and hydration device 800 may have similar or identical features as those described with respect to the exercise and hydration devices 100, 200, 300 of FIGS. 1-7. As shown, the exercise and hydration device 800 includes a tubular body 802. The tubular body 802 may include a first end 804 and a second end 806. The first end 804 of the tubular body 802 may define an aperture 808 that provides access to a cavity. The aperture 808 may be sealed by a cap 810. The second end 806 of the tubular body 802 may include a cover, cap, or base 812.

In the depicted embodiment, the tubular body 802 is divided evenly into a plurality of body segments 808*a, b, c*. In the depicted embodiment, the compactible exercise and hydration device 800 includes three body segments 808*a, b, c*; however, more or less body segments 808*a, b, c* are contemplated depending, for example, on the length of the compactible exercise and hydration device 800 and the desired size of each segment based on desired compactibility. The body segments 808*a, b, c* may be removably coupled to one another, allowing the compactible exercise and hydration device 800 to be disassembled into pieces to facilitate travel.

The body segments 808*a, b, c* may have first body segment ends 814*a, b, c* and second body segment ends 816*a, b, c*. The first body segment ends 814*a, b, c* may include male couplings. In the depicted embodiment, the male couplings are threaded ends of the body segments 808*a, b, c*. The second body segment ends 816*a, b, c* may include female couplings. In the depicted embodiment, the female coupling is threading on an inside surface of the body segment. The first body segment ends 814*a, b, c*, may couple to the second body segment ends 816*a, b, c* by a threaded connection. It is contemplated that the male and female couplings may be switched. For example, the first body segment ends 814*a, b, c* may include female couplings and the second body segment ends 816*a, b, c* may include male couplings. It is contemplated that the body segments 808*a, b, c* may be coupled by other means, including snap attachments, collared quick connect, sleeve coupling, a coarse threaded connection, or the like. The compactible exercise and hydration device 800 may include a plurality of O-rings 818*a,b* between the plurality of body segments 808*a, b, c*. For example, the O-rings 818*a,b* may be positioned around the male couplings and create a tight seal between the body segments 808*a, b, c* when threaded together. The connections between body segments 808*a, b, c* may be water tight, preventing any liquid stored inside the cavity from leaking out of the exercise and hydration device 800. The connections between body segments 808*a, b, c* may be such that the outer surfaces of the body segments 808*a, b, c* are flush with one another and the outer surface of the tubular body 802 is smooth.

Figure 12:
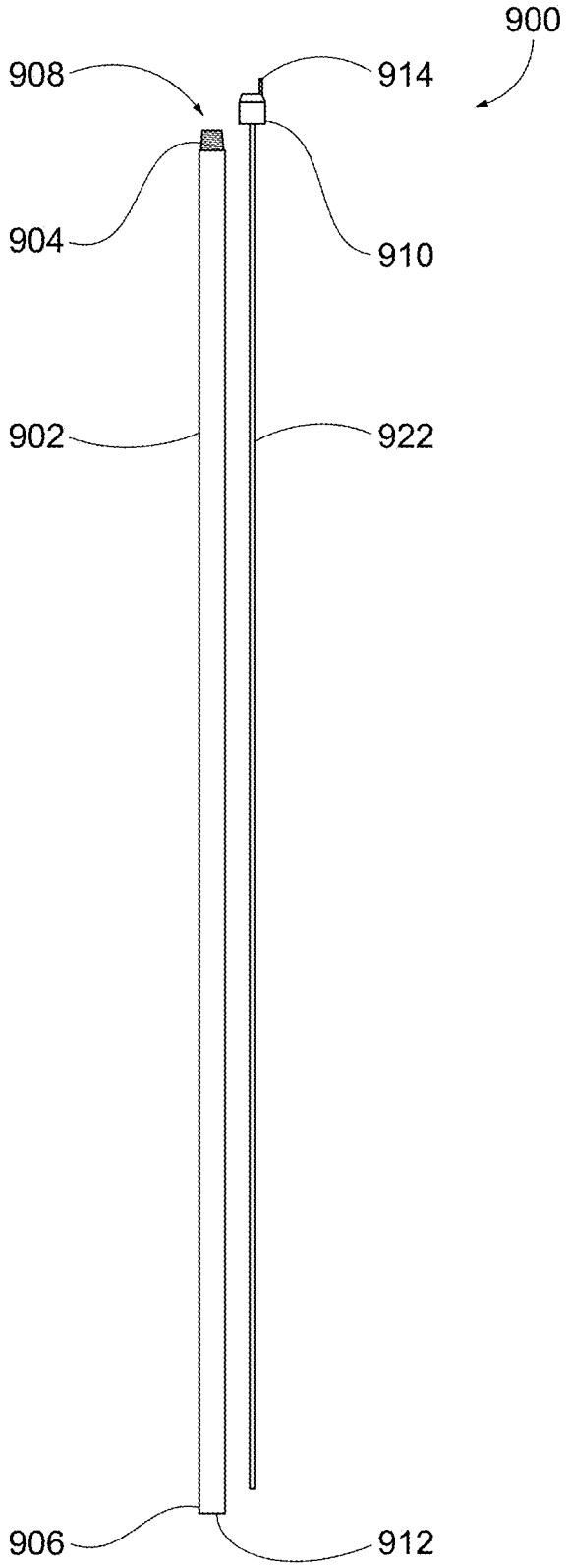
FIG. 12 is a front elevation partially exploded view of another embodiment of an exercise and hydration device including a straw.
Figure 13:
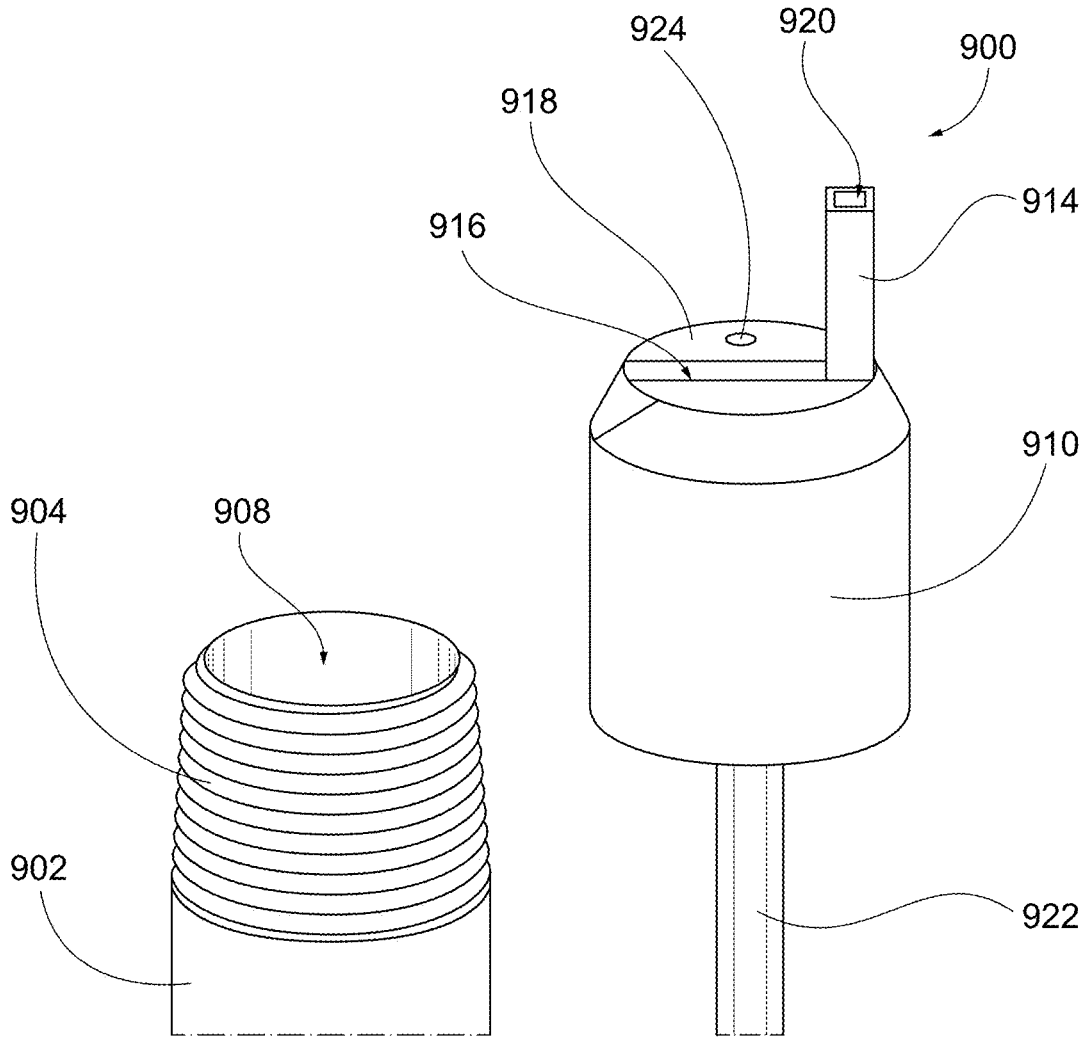
FIG. 13 is a zoomed in view of the spout of the exercise and hydration device of FIG. 12.

In some embodiments, disclosed exercise and hydration devices may include a spout and/or straw to facilitate drinking liquid stored therein. FIG. 12 is a front elevation partially exploded view of an exemplary embodiment of an exercise and hydration device 900 including a spout and straw. FIG. 13 is a zoomed in view of the spout of the exercise and hydration device 900 of FIG. 12. The exercise and hydration device 900 may have similar or identical features as those described with respect to the exercise and hydration devices 100, 200, 300, and 800 of FIGS. 1-7 and 11. As shown, the exercise and hydration device 900 includes a tubular body 902. The tubular body 902 may include a first end 904 and a second end 906. The first end 904 of the tubular body 902 may define an aperture 908 that provides access to a cavity. The aperture 908 may be sealed by a cap 910. The second end 906 of the tubular body 902 may include a cover, cap, or base 912. In the depicted embodiment, the cap 910 includes a spout 914. The spout 914 may be positioned in a spout recess 916 formed in a top surface 918 of the cap 910. When positioned in the spout recess 916, the spout 914 may be in a stored position or orientation. The spout 914 may be pivotally coupled to the cap 910, allowing the spout 914 to transition from a stored position to an open position. FIGS. 12-13 show the spout 914 in the open position. The spout 914 may include a spout aperture 920 that provides access to a cavity or channel formed inside the spout 914. The cap 910 and spout 914 may be coupled to a straw 922. The cavity of the spout 914 may align with a cavity of the straw 922 allowing liquid to flow from the straw 922 through the spout 914 and out the spout aperture 920 as a user sucks on the spout 914 for drinking.

The cap 910 may include a valve or vent 924 positioned on the top surface 918. The valve or vent 924 may allow atmospheric air into a cavity inside the tubular body 902 to allow a user to suck liquid through the spout 914. While the valve or vent 924 is depicted on the cap 910, it is contemplated that the valve or vent 924 may be positioned on the spout 914.

Figure 14:
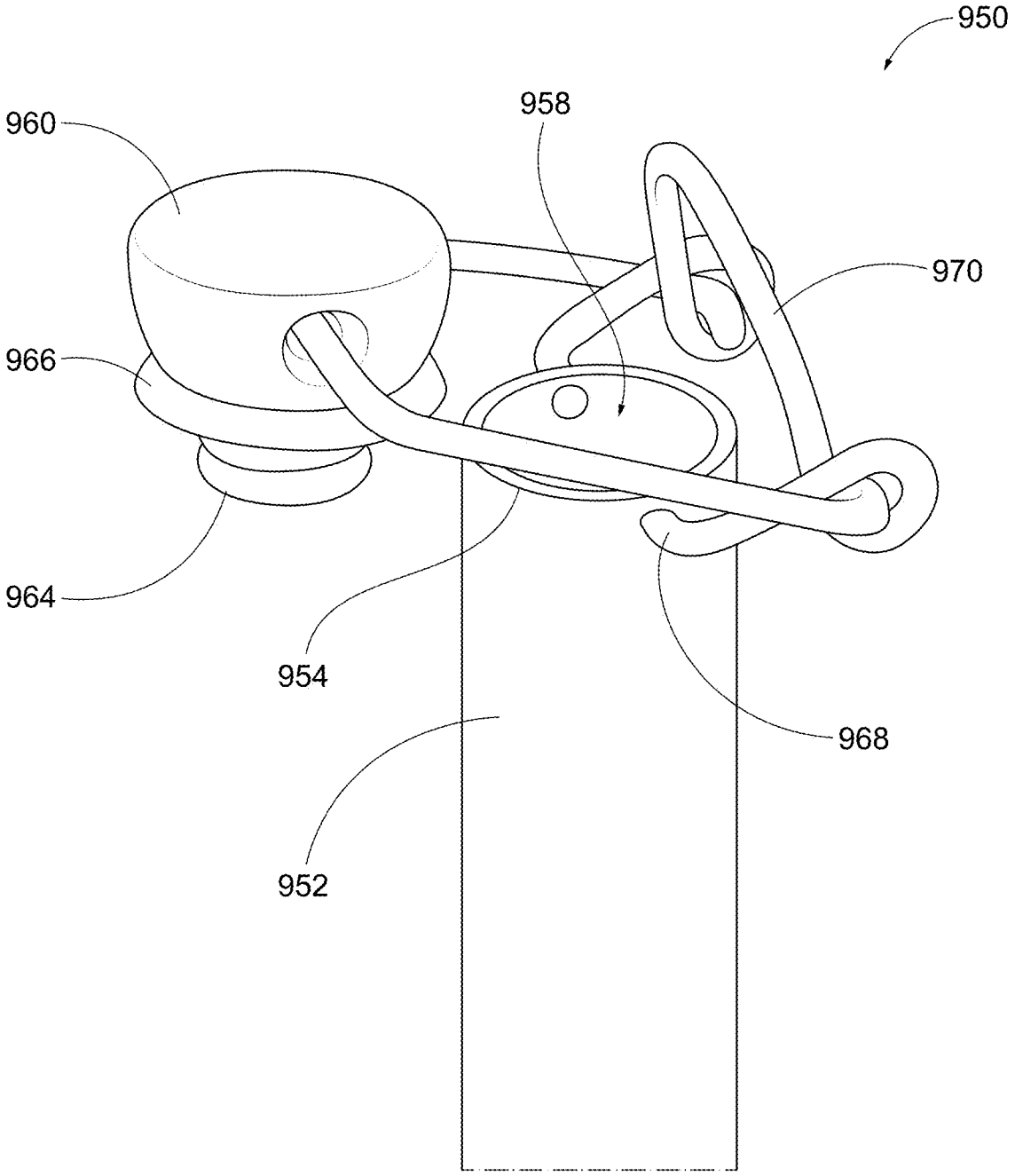
FIG. 14 is a zoomed-in isometric view of a top portion of another embodiment of an exercise and hydration device with a different type of cap.

FIG. 14 is a zoomed-in isometric view of a top portion of another embodiment of an exercise and hydration device 950 with a different type of cap. The exercise and hydration device 950 may have similar or identical features as those described with respect to the exercise and hydration devices 100, 200, 300, and 800 of FIGS. 1-7 and 11. As shown, the exercise and hydration device 950 includes a tubular body 952. The tubular body 952 may include a first end 954 and a second end (not shown). The first end 954 of the tubular body 952 may define an aperture 958 that provides access to a cavity. The aperture 958 may be sealed by a cap 960. The second end of the tubular body 952 may include a cover, cap, or base, similar to that depicted with respect to FIGS. 1-7 and 11. In the depicted embodiment, the cap 960 is a conventional flip top or swing top cap. As shown, the cap 960 includes a plug 964 and a seal 966. The plug 964 may be positioned inside the aperture 958 and the seal 966 couples with the aperture 958 to seal the aperture 958 with a watertight seal. The cap 960 may be coupled to the tubular body 952 by a hinge 968. The hinge 968 may be coupled to a lever 970. The lever 970 may allow a user to tighten or release the connection between the cap 960 and the aperture 958. For example, pushing down on the lever 970 may tighten the connection, while pulling up on the lever 970 may release the connection. A flip top or swing cap such as the one depicted in FIG. 14 may facilitate opening of the exercise and hydration device 950 while exercising to hydrate. For example, a flip top or swing cap may be opened with one hand while a user is exercising.

Figure 15:
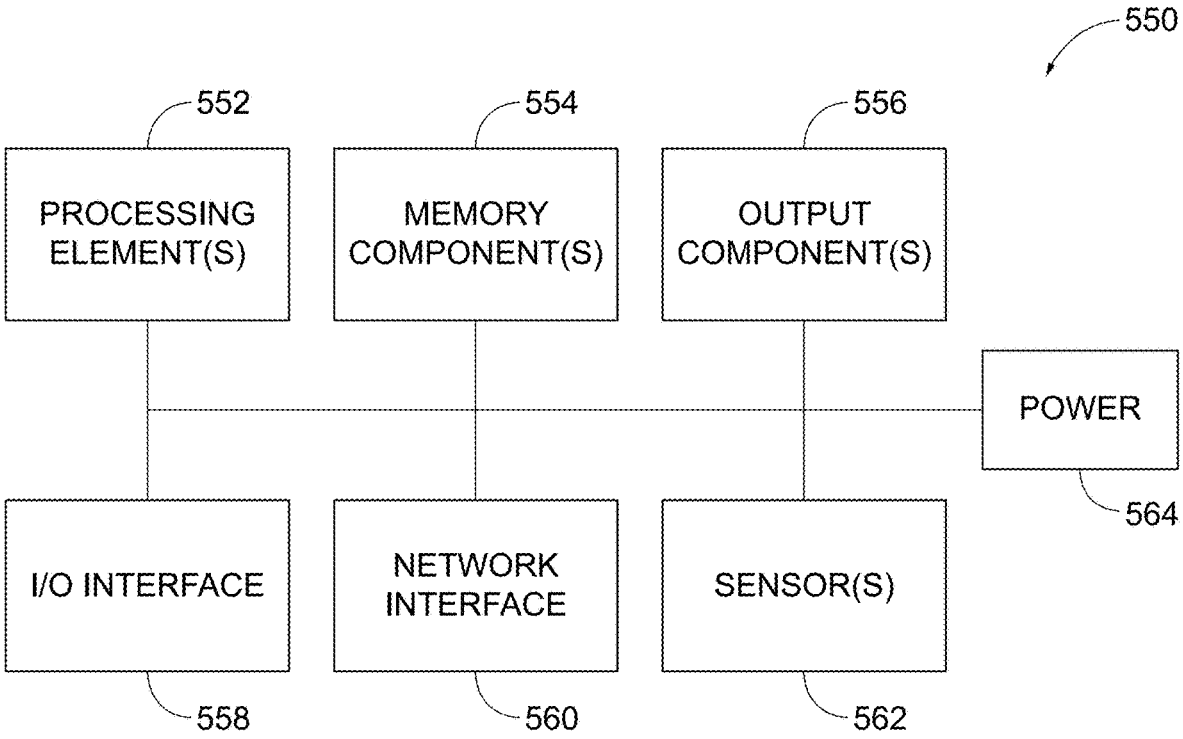
FIG. 15 is a simplified block diagram of a computing device that can be incorporated into a disclosed exercise and hydration device.

It is contemplated that a disclosed exercise and hydration device may include a computing device. FIG. 15 is a simplified block diagram of a computing device 550 that may be used with or integrated into a disclosed exercise and hydration device (e.g., exercise and hydration devices 100, 200, 300, 400, 500, 800, 900, 950). For example, a disclosed exercise and hydration device may include one or more of the components shown in FIG. 15. With reference to FIG. 15, the computing device 550 may include one or more of one or more processing elements 552, an input/output interface 558, one or more feedback or output components 556, one or more memory components 554, a network interface 560, one or more sensors 562, and a power source 564. Each of the various components may be in communication with one another through one or more buses, wireless means, or the like.

The local processing element 552 is any type of electronic device capable of processing, receiving, and/or transmitting instructions. For example, the local processing element 552 may be a central processing unit, microprocessor, processor, or microcontroller. Additionally, it should be noted that select components of the computing device 550 may be controlled by a first processor and other components may be controlled by a second processor, where the first and second processors may or may not be in communication with each other. The local processing element 552 may receive user data (e.g., via a touch screen), sensor data (e.g., via the one or more sensors 562), and/or historical data, analyze the received data, and transmit feedback to a user (e.g., via the I/O interface 558 or output component(s) 556). User data may include, for example, personal/biometric data (e.g., height, weight, age, gender, heart rate, BMI, $VO_2$ max, etc.), historical health data (e.g., existing health issues such as asthma), and the like. User data may be input by a user or received by the one or more sensors 562. Sensor data may include data received from the one or more sensors 562, including, for example, data related to speed, position, force, heart rate, BMI, $VO_2$ max, gait, and the like. Historical data may include data collected and stored by the computing device 550 (e.g., via the one or more memory components 554). For example, historical data may include data related to prior distance(s), speed(s), route(s), heart rate(s), and the like, experienced by a user during a cardio workout with the exercise and hydration device.

The one or more memory components 554 are used by the computing device 550 to store instructions for the local processing element 552, as well as store data, such as user data, sensor data, historical data, and the like. The one or more memory components 554 may be, for example, magneto-optical storage, read-only memory, random access memory, erasable programmable memory, flash memory, or a combination of one or more types of memory components.

The one or more feedback or output components 556 may provide visual, haptic, or audible feedback to a user. For example, the one or more output components 556 may include a display that provides visual feedback to a user and, optionally, can act as an input element to enable a user to input data or to control, manipulate, and calibrate various components of the computing device 550. The display may be a liquid crystal display, plasma display, organic light-emitting diode display, and/or cathode ray tube display. In embodiments where the display is used as an input, the display may include one or more touch or input sensors, such as capacitive touch sensors, resistive grid, or the like. As another example, the one or more output components 556 may include a light (e.g., LED). In this manner, a disclosed exercise and hydration device may be used as a flashlight for a user to better see in the dark or the light may be useful for others to see the user in the dark (e.g., a flashing warning light).

The I/O interface 558 allows a user to enter data into the computing device 550, as well as provides an input/output for the computing device 550 to communicate with other devices. The I/O interface 558 can include one or more input buttons, touch pads, and so on.

The network interface 560 may provide communication to and from the computing device 550 to other devices. The network interface 560 may include one or more communication protocols, such as, but not limited to Wi-Fi, Ethernet, Bluetooth, and the like. The network interface 560 may also include one or more hardwired components, such as a Universal Serial Bus (USB) cable, or the like.

The one or more sensors 562 may include one or more position sensors and/or biometric sensors, including, for example, one or more GNSS sensors (e.g., GPS), load cell sensors, ultrasonic sensors, motion sensors, accelerometers, gyroscopes, magnetometers, force sensors, extensometers, goniometers, inclinometers, heart rate sensors, oxygen sensors, muscle sensors, and the like. The one or more sensors 562 may collect sensor data and transmit the sensor data to the local processing element 552.

The power source 564 is used to provide power to the computing device 550, e.g., a battery. In some embodiments, the power source 564 is rechargeable. In some embodiments, the power source 564 is a constant power management feed. In other embodiments, the power source 564 is intermittent (e.g., controlled by a power switch or activated by an external signal). The power source 564 may include an auxiliary power source.

The one or more components of the computing device 550 may be positioned within a cavity defined by a tubular body of a disclosed exercise and hydration device. The cavity may be separate from the cavity described that holds the potable liquid. In some embodiments, one or more components of the computing device 550 (e.g., a GPS sensor or display) may be coupled to an outer surface of the tubular body.

The computing device 550 may enable a user to track his or her performance during a cardio workout or over a period of time (e.g., via historical data collected and stored). As an example, the computing device 550 may provide a user with data related to the distance and speed traveled during a cardio workout. As another example, the computing device 550 may track the weight of the exercise and hydration device over the course of the cardio workout and provide feedback to a user. As the user drinks from the exercise and hydration device and the weight of the exercise and hydration device is reduced, the user's strength training may vary. The user may be able to review on a display data related to the change in weight of the exercise and hydration device over time, which may be indicative of the user's strength training and hydration during the workout.

Figure 16:
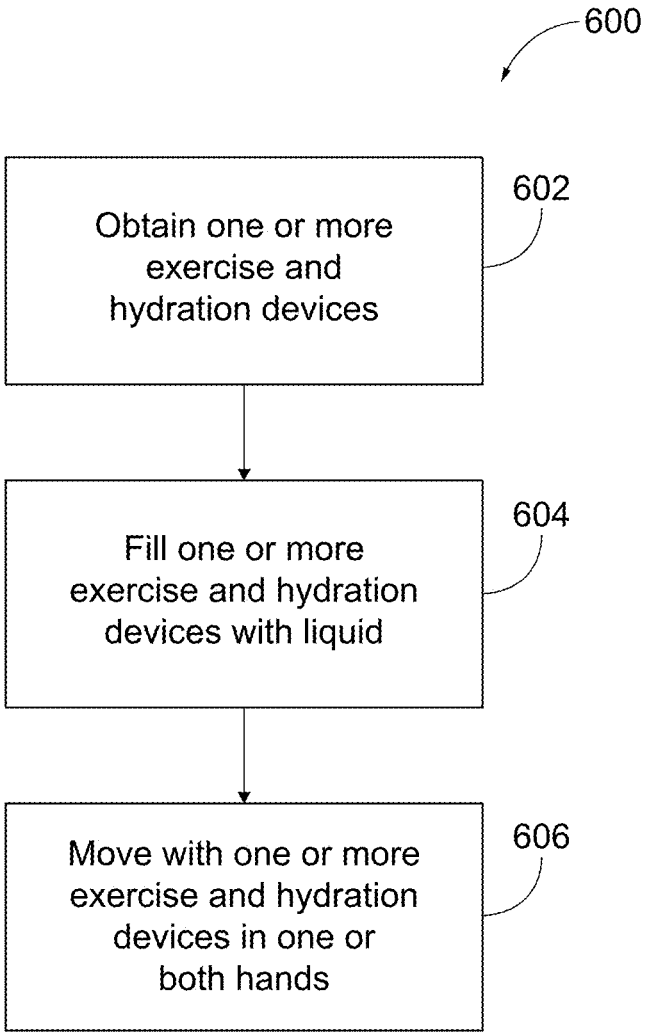
FIG. 16 is a flow chart illustrating a method of using one or more disclosed exercise and hydration devices.

FIG. 16 is a flow chart illustrating a method of using one or more disclosed exercise and hydration devices. The method 600 begins with operation 602 and one or more exercise and hydration devices are obtained by a user. The one or more exercise and hydration devices may be one or more of the exercise and hydration devices 100, 200, 300, 400, 500, 800, 900, 950 described with respect to FIGS. 1-14. For example, one of the exercise and hydration devices 100, 400, 500, 800, 900, 950 may be obtained. As another example, two of the exercise and hydration devices 200, 300 may be obtained.

After operation 602, the method 600 may proceed to operation 604 and the one or more exercise and hydration devices may be filled with a liquid. For example, a cap may be removed from the exercise and hydration device (e.g., cap 114, 315, 506, 810, 910, 960 from the respective first ends or tubular bodies 104, 304, 502, 804, 904, 954 of the respective exercise and hydration devices 100, 300, 500 800, 900, 950). For example, the cap may be unscrewed or popped off of the exercise and hydration device. The liquid may be poured through the aperture that was covered by the cap (e.g., apertures 112, 212 of the exercise and hydration devices 100, 200, respectively). The entire cavity, or a portion thereof, inside the exercise and hydration device may be filled with liquid (e.g., cavities 110, 210 of the exercise and hydration devices 100, 200, respectively). The cap may be coupled to the exercise and hydration device to reseal the aperture once the liquid is inside the cavity. If the base (e.g., bases 120, 220, 312, 812, 912, 962) has a cap, the base cap may be removed to fill the exercise and hydration device with water.

After operation 604, the method 600 may proceed to operation 606 and the user may move with the one or more exercise and hydration devices in one or both hands. The movement may be a cardio exercise or workout, including for example, walking, running, hiking, or the like. The movement may include twisting the torso to the left and the right. The movement may include bending at the knees. FIGS. 17-27 show images of exemplary movements executed by a user holding the one or more exercise and hydration devices.

Figure 17:
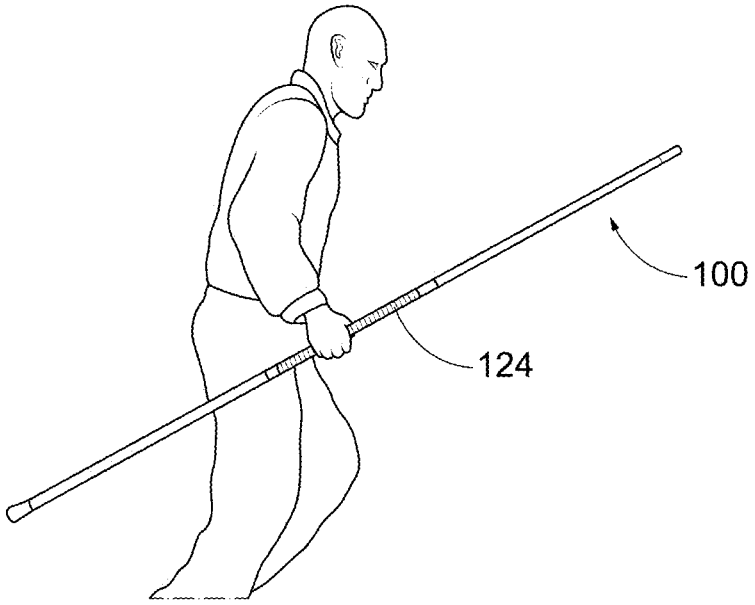
FIG. 17 is an image of a user exercising with the exercise and hydration device of FIG. 1 according to a first method.

FIGS. 17-21C show images of a user exercising with the exercise and hydration device 100 of FIG. 1 according to various methods that effectively increase upper body strength training and/or dynamic stretching as the user runs or walks. FIG. 17 is an image of a user exercising with the exercise and hydration device 100 of FIG. 1 according to a first method. As shown, the user is running with the exercise and hydration device 100 in his right hand. The user is gripping the grip 124 below the center point of the tubular body 102. The user is running with the exercise and hydration device 100 at a 45 degree angle to the user's body and to the ground. The user's arm is slightly bent, activating the user's bicep. The user's shoulder may also be engaged. The user may try to maintain the position of the exercise and hydration device 100 adjacent to the user's body and at the 45 degree angle. To maintain this position of the exercise and hydration device 100, the user may need to counteract the user's kinetic motion as the user runs, providing an enhanced upper body strengthening workout.

Figure 18:
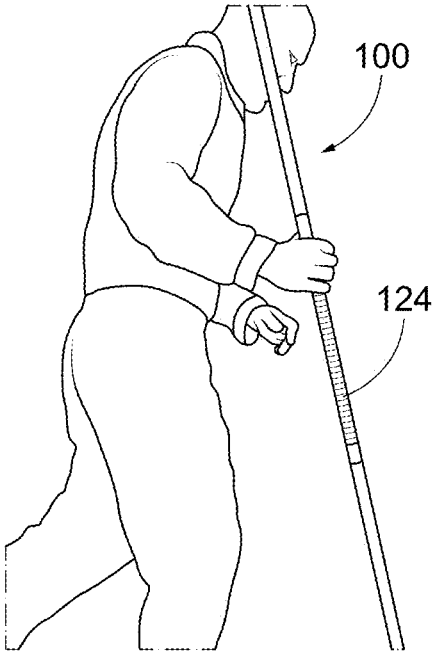
FIG. 18 is an image of a user exercising with the exercise and hydration device of FIG. 1 according to a second method.

FIG. 18 is an image of a user exercising with the exercise and hydration device 100 of FIG. 1 according to a second method. In this embodiment, the user is placing the base 120 on the ground in front of the user, running or walking to the point of contact of the exercise and hydration device 100 with the ground, lifting the exercise and hydration device 100 up and repeating. The user may place slight force on the exercise and hydration device 100 towards the ground, engaging different muscles in the arm, and improving the user's balance as the user runs or walks. It is contemplated that using the exercise and hydration device 100 in this manner (lifting the weight upwards and then using the exercise and hydration device 100 to push off the ground into the next step) may improve strength in the upper body fascia, improve stability, and/or relieve stress on the lower extremities. Such functionality may be useful on steep slopes. By frequently placing the exercise and hydration device 100 on the ground, the user may reduce tension or strain on the user's muscles. This use of the exercise and hydration device 100 may be beneficial during a cardio workout as the user gets tired, e.g., for long distance runs or walks. This use of the exercise and hydration device 100 may also be beneficial if the terrain is rocky or icy, e.g., to improve balance.

Figure 19A:
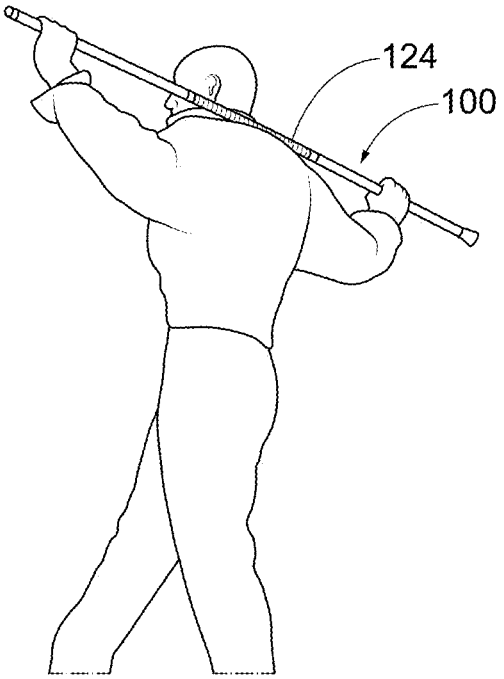
FIGS. 19A-B are images of a user exercising with the exercise and hydration device of FIG. 1 according to a third method.
Figure 19B:
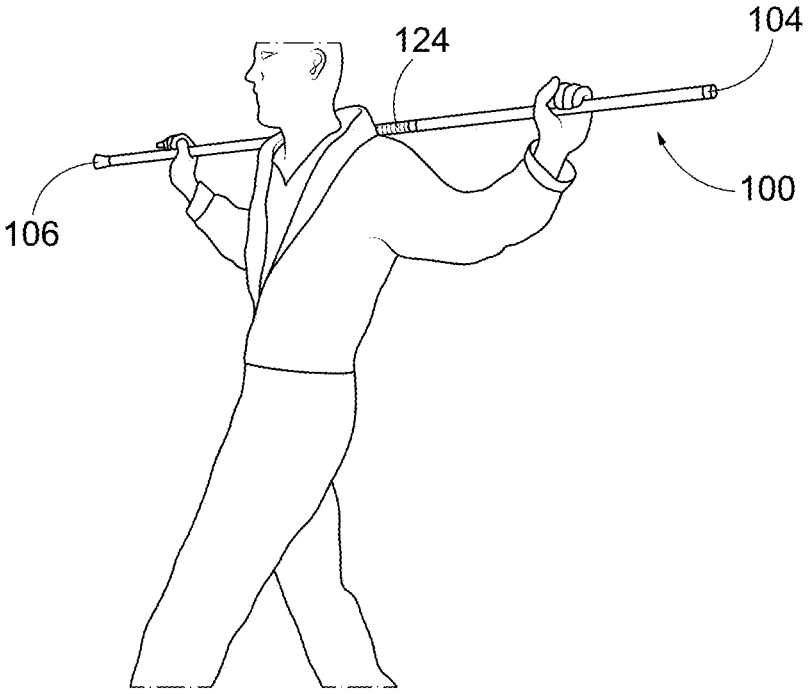

FIGS. 19A-B are images of a user exercising with the exercise and hydration device 100 of FIG. 1 according to a third method. In the depicted embodiment, the user places the exercise and hydration device 100 across the user's shoulders and behind the user's neck. As shown, the grip 124 rests on the user's neck, providing a soft and comfortable positioning of the exercise and hydration device 100 against the user. The user grips the exercise and hydration device 100 near the first and second ends 104, 106, respectively. The user rotates at the user's torso as the user walks, swinging the exercise and hydration device 100 to the left and right. This movement may activate the core and provide dynamic stretching of the back muscles. The weight of the exercise and hydration device 100 as the user rotates may provide a more enhanced or improved stretch of the back muscles.

Figure 20:
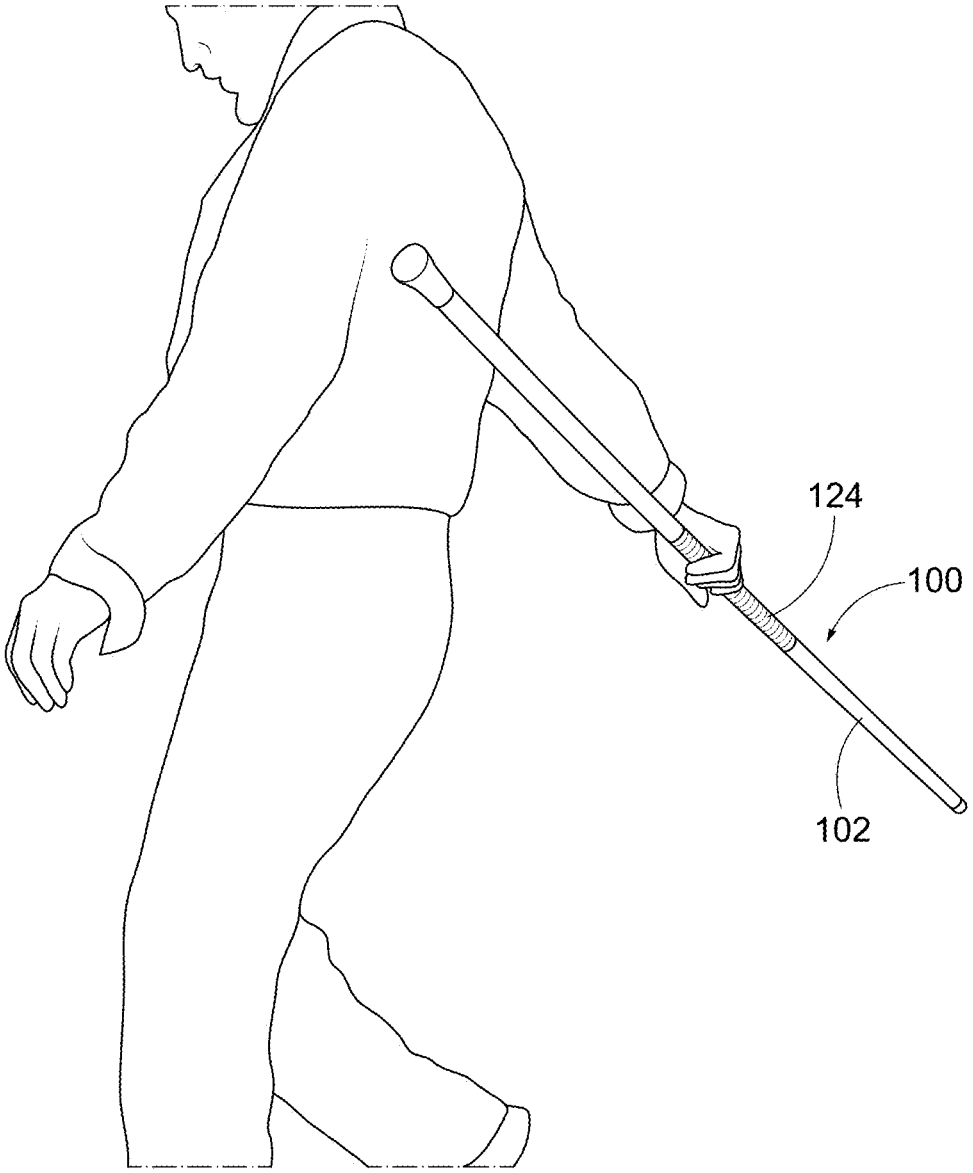
FIG. 20 is an image of a user exercising with the exercise and hydration device of FIG. 1 according to a fourth method.

FIG. 20 is an image of a user exercising with the exercise and hydration device 100 of FIG. 1 according to a fourth method. As shown, the user is walking or running with the exercise and hydration device 100 in his right hand. The user grips the grip 124 off-center near an end of the grip such that more of the tubular body 102 is positioned away from the user's body. The user swings his arm behind his back at about a 45 degree angle to his body. The exercise and hydration device 100 is parallel to the user's arm and swings behind the user's body. The user may move his arm in front, swinging the exercise and hydration device 100 to the front of the user's body at a similar angle. This motion may provide a dynamic stretch to the user's shoulder as the user walks or runs.

Figure 21A:
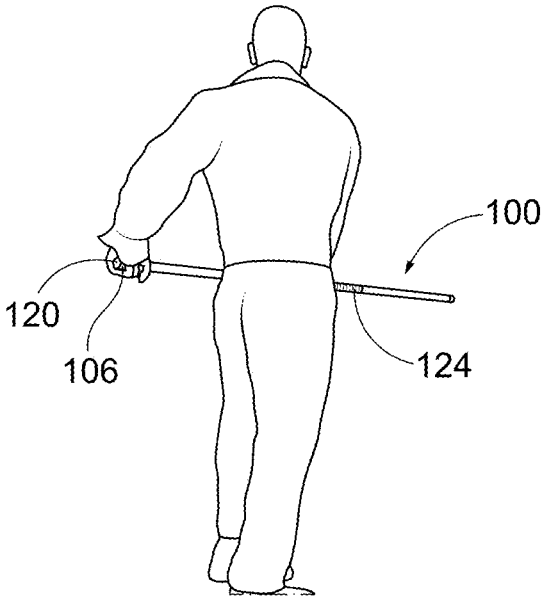
FIGS. 21A-C are images of a user exercising with the exercise and hydration device of FIG. 1 according to a fifth method.
Figure 21B:
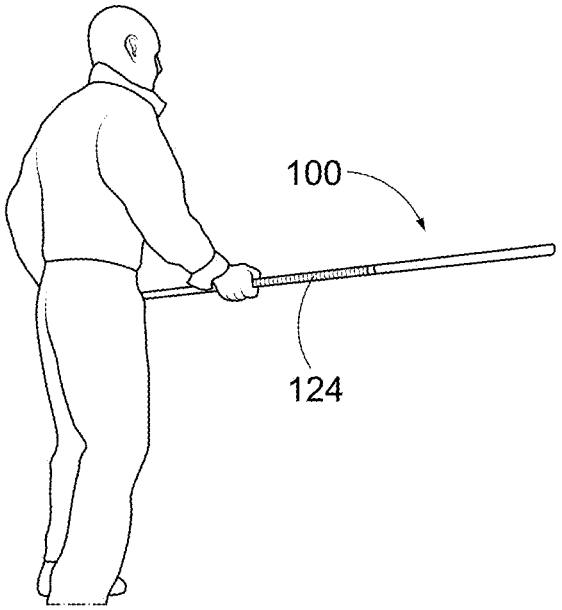
Figure 21C:
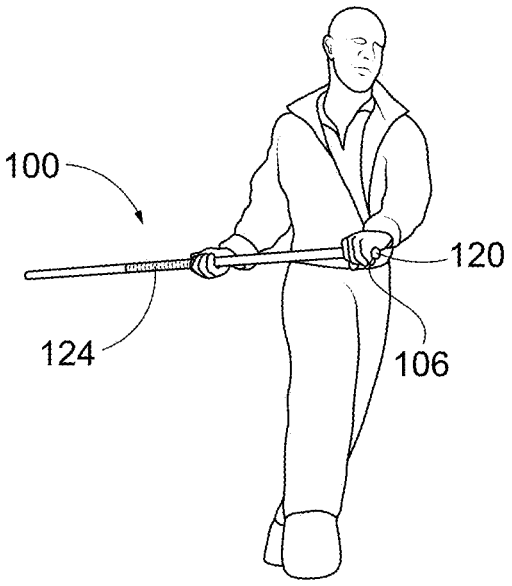

FIGS. 21A-C are images of a user exercising with the exercise and hydration device 100 of FIG. 1 according to a fifth method. As shown, the user holds the exercise and hydration device 100 towards the second end 106 with one hand at an end of the grip 124 and one hand at the base 120 such that the user's hands are slightly more than shoulder width apart. The user's arms are slightly bent to activate the user's biceps. The user maintains these hand positions as the user rotates his torso from left to right while the user walks or runs. This movement may activate the core and provide dynamic stretching of the back muscles. The weight of the exercise and hydration device 100 as the user rotates may provide a more enhanced or improved stretch of the back muscles. The user's off-center grip may increase the weight of the exercise and hydration device 100 as the user rotates.

Figure 22:
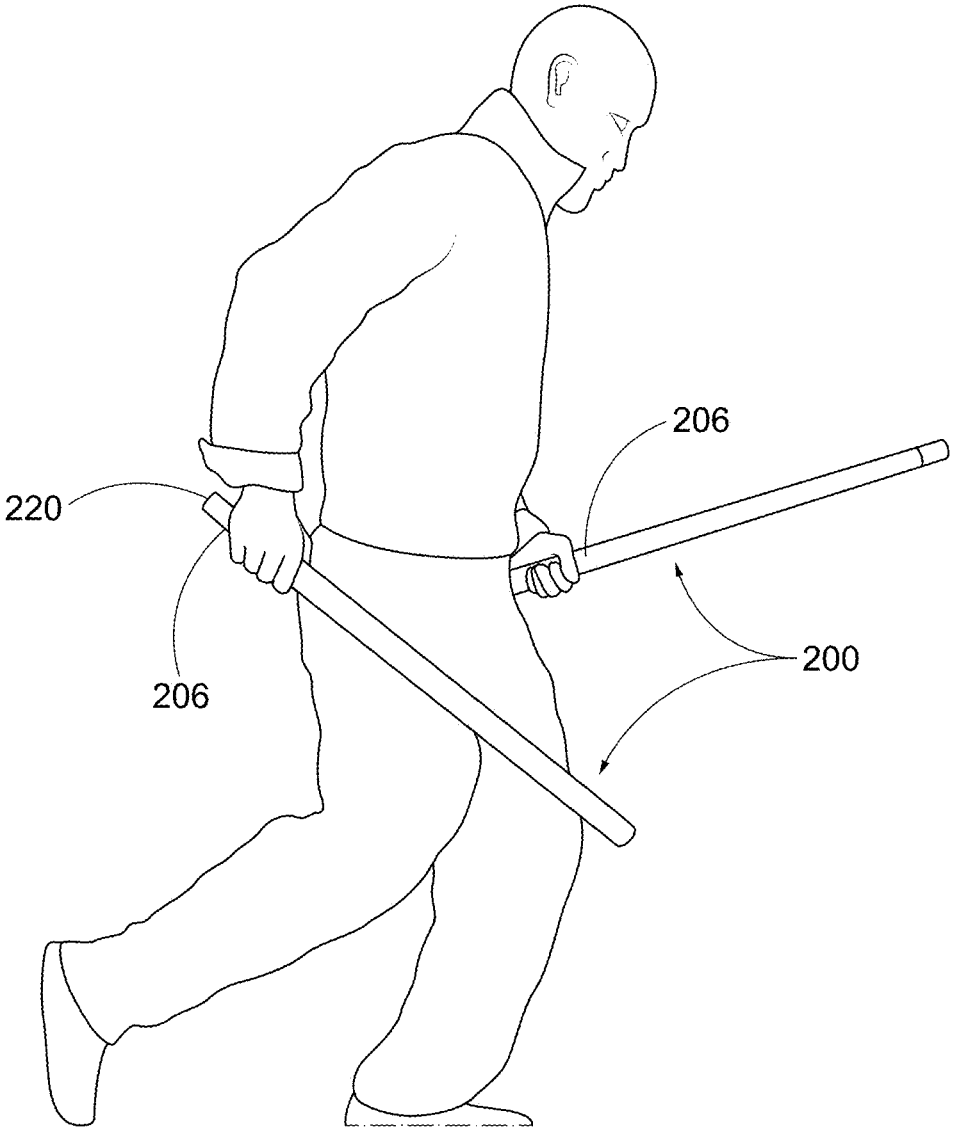
FIG. 22 is an image of a user exercising with two of the exercise and hydration devices of FIG. 5 according to a first method.

FIGS. 22-24D show images of a user exercising with the exercise and hydration device set 230 of FIG. 5 according to various methods that effectively increase upper body strength training and/or dynamic stretching as the user runs, walks, or hikes. FIG. 22 is an image of a user exercising with the exercise and hydration device set 230 of FIG. 5 according to a first method. As shown, the user has an exercise and hydration device 200 in each hand. The user holds the exercise and hydration devices 200 at their respective second ends 206 near the bases 220. The user swings the exercise and hydration devices 200 in line with the user's natural arm swings as the user runs, with the user's arms slightly bent engaging the user's biceps. By holding the exercise and hydration devices 200 at an end, the weight of exercise and hydration devices 200 may be increased and the user's wrist may be engaged to a greater degree than if the devices were held towards the center.

Figure 23A:
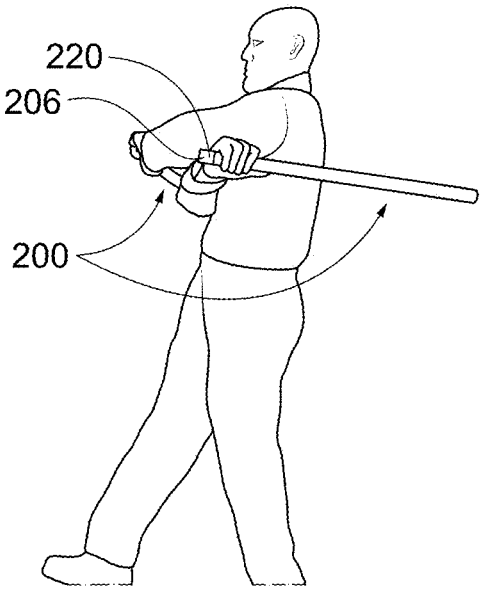
FIGS. 23A-C are images of a user exercising with two of the exercise and hydration devices of FIG. 5 according to a second method.
Figure 23B:
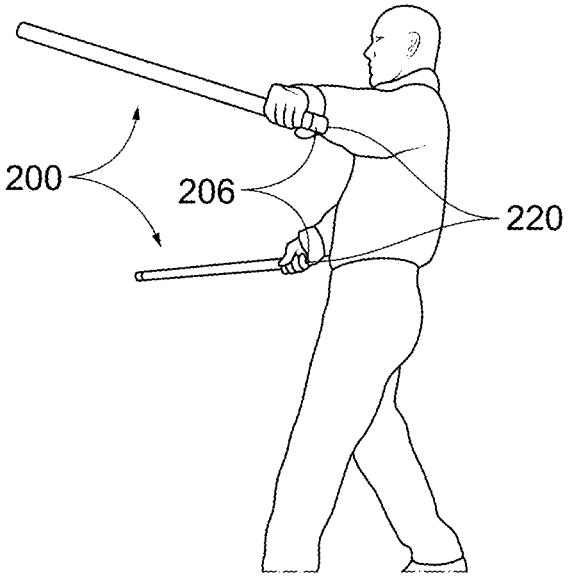
Figure 23C:
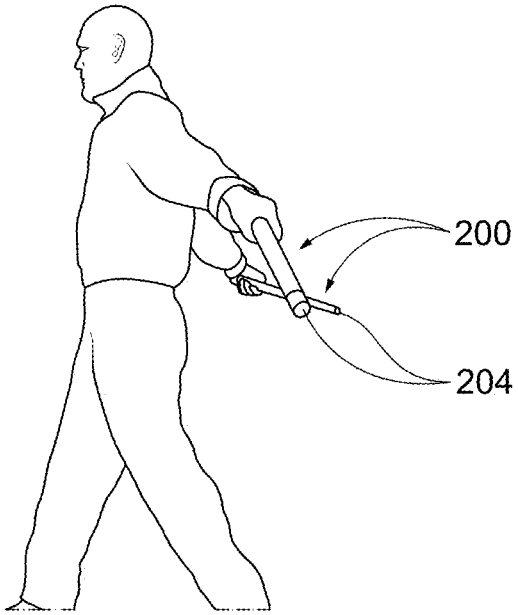
Figure 24A:
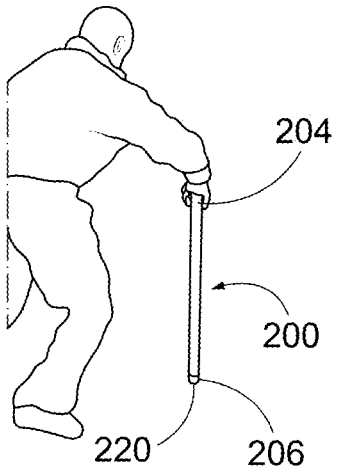
FIGS. 24A-D are images of a user exercising with two of the exercise and hydration devices of FIG. 5 according to a third method.
Figure 24B:
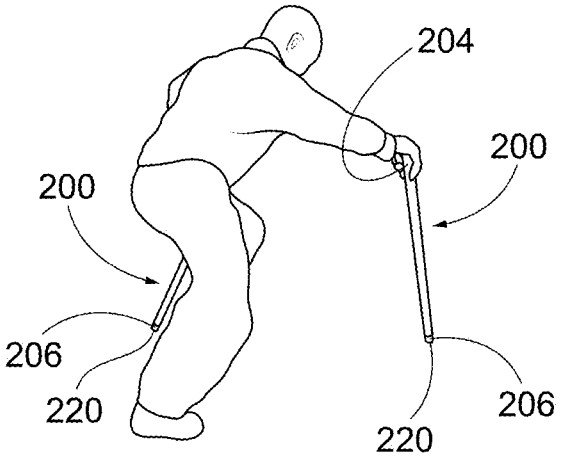
Figure 24C:
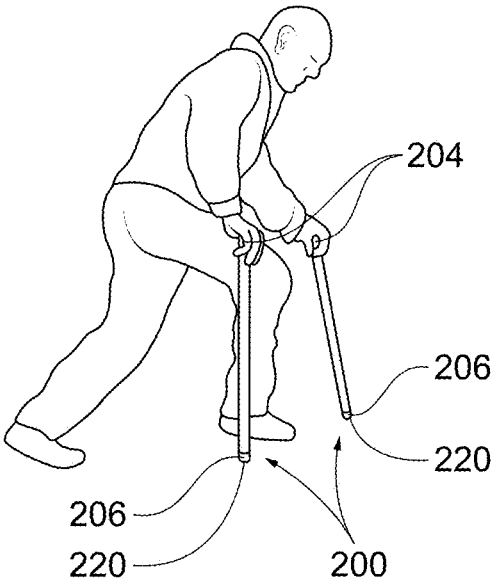
Figure 24D:
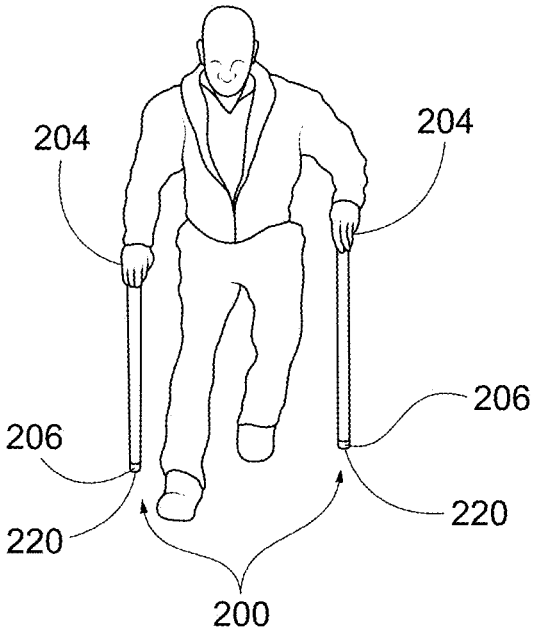

FIGS. 23A-C are images of a user exercising with the exercise and hydration device set 230 of FIG. 5 according to a second method. In the depicted embodiment, the user has an exercise and hydration device 200 in each hand. The user holds the exercise and hydration devices 200 at their respective second ends 206 near the bases 220. As shown in FIG. 23A, the user swings the exercise and hydration devices 200 across the user's body, crossing the user's arms such that the exercise and hydration devices 200 are positioned on either side of the user's body with the first ends 204 facing behind the user's body. As shown in FIG. 23B, the user uncrosses his arms and extends his arms outwards. As shown in FIG. 23C, the user may continue the outward extension of his arms until his arms are behind him. Such movement allows for dynamic stretching of the user's back and chest muscles as he walks or runs, with the exercise and hydration devices 200 adding weight at the end of the user's arms to improve or enhance the stretch.

FIGS. 24A-D are images of a user exercising with the exercise and hydration device set 230 of FIG. 5 according to a third method. As shown, the user has an exercise and hydration device 200 in each hand and places the exercise and hydration devices 200 on the ground as the user walks or runs up and down the hill (e.g., hiking or trail running). The first end 204 is in the user's hand and the second end 206 and base 220 is placed on the ground. The length l of the exercise and hydration devices 200 is optimal for improving the user's posture as the user walks/runs up and down the hill. Due to the length 1 of the exercise and hydration devices 200, the user holds the first ends 204 from above the first ends 204 to contact the exercise and hydration devices 200 with the ground. As the user places the base 220 of the exercise and hydration device 200 on the ground, the user's wrist is parallel to or partially angled from (e.g., less than a 180 degree angle but greater than a 90 degree angle, such as a 135 degree angle or greater) the length 1 of the exercise and hydration device 200. This positioning of the wrist transmits the force of impact created by striking the exercise and hydration device 200 against the ground into the wrist and through the arm in a linear path. Such positioning of the wrist reduces tension and stress on the wrist and allows the user to place more weight on the exercise and hydration device 200 than if the user's wrist were at a 90 degree angle. By placing weight on the exercise and hydration device 200, the user is able to reduce tension in the user's joints (e.g., the knees and/or hips). The length 1 of the exercise and hydration devices 200 further allows the user to bend his knees, which may take additional strain off the joints. The user may lower his hips, which may engage the front thighs, glutes, and calves.

The exercise and hydration device 300 of FIG. 7 may be used for hiking or trail running. For example, two exercise and hydration devices 300 may be used in a similar manner as the exercise and hydration devices 200 described with respect to FIGS. 24A-D. The height or length x of the exercise and hydration devices 300 may be adjusted as the user walks up or down the hill. For example, the base 320 may be pushed further into the tubular body 302 to shorten the length x of the exercise and hydration device 300 when the user is walking uphill. By shortening the length x of the exercise and hydration devices 300, the user's positioning as the user walks up the hill is modified for improved performance and tension is reduced on the user's joints. The shortened length x may allow the user to grab the exercise and hydration devices 300 in a similar manner as described with respect to the user's grip on the exercise and hydration devices 200 in FIGS. 24A-D. The base 320 may be pulled out further from the tubular body 302 to extend the length x of the exercise and hydration device 300 when the user is walking or running downhill, as the distance is increased between the user's arms and the ground when the user walks or runs downhill. In this manner, by adjusting the length of the exercise and hydration devices 300, the user is able to maintain good posture as the user walks or runs up and down the hill.

Figure 25:
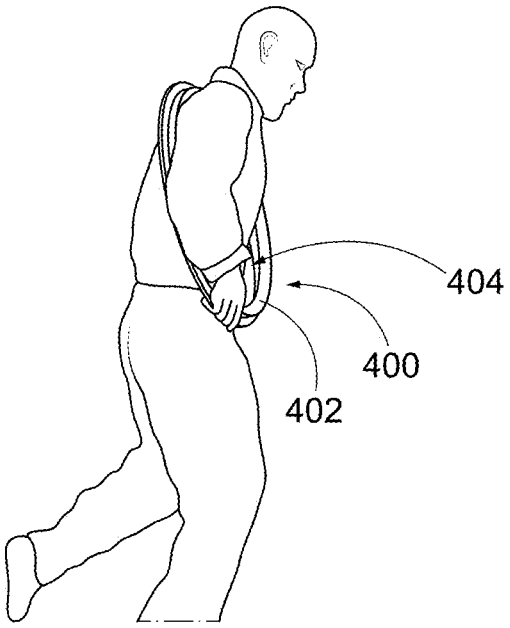
FIG. 25 is an image of a user exercising with the exercise and hydration device of FIG. 8 according to a first method.

FIG. 25 is an image of a user exercising with the exercise and hydration device 400 of FIG. 8 according to a first method. As shown, the user places his head, neck, right arm, and shoulder inside the opening 404 defined by the tubular body 402. The tubular body 402 rests on his left shoulder as the user walks runs. The user may hold the tubular body 402 with his right hand to stabilize the exercise and hydration device 400 on his shoulder. For example, the user may hold the groove 406 or grip if included. In the depicted image, the weight of the exercise and hydration device 400 rests on the user's left shoulder, activating the user's left side of his upper body as the user walks or runs. The user may switch the shoulder that the exercise and hydration device 400 rests on for an even upper body strength training.

Figure 26:
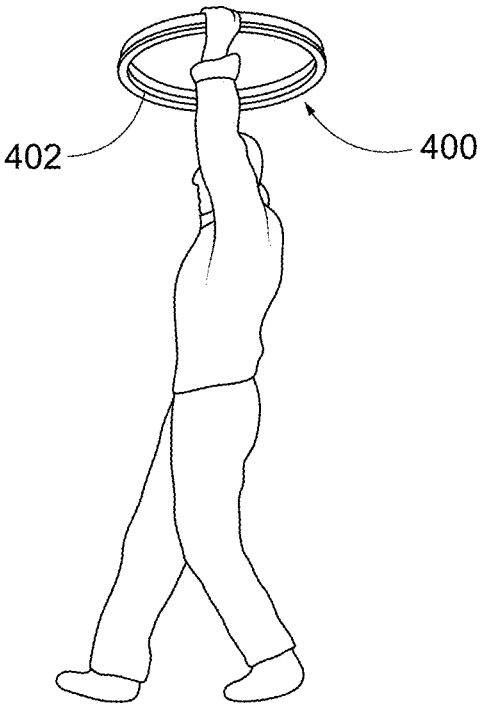
FIG. 26 is an image of a user exercising with the exercise and hydration device of FIG. 8 according to a second method.

FIG. 26 is an image of a user exercising with the exercise and hydration device 400 of FIG. 8 according to a second method. As shown, the user holds opposing sides of the tubular body 402 and holds the exercise and hydration device 400 over the user's head with his arms extended. This position may strengthen the arms and shoulders, adding an upper body workout as the user walks or runs. The user may move the exercise and hydration device 400 closer and further from the user's head for an added strength workout. By bending the user's arms, the user may activate the user's arm muscles (e.g., biceps and triceps).

Figure 27:
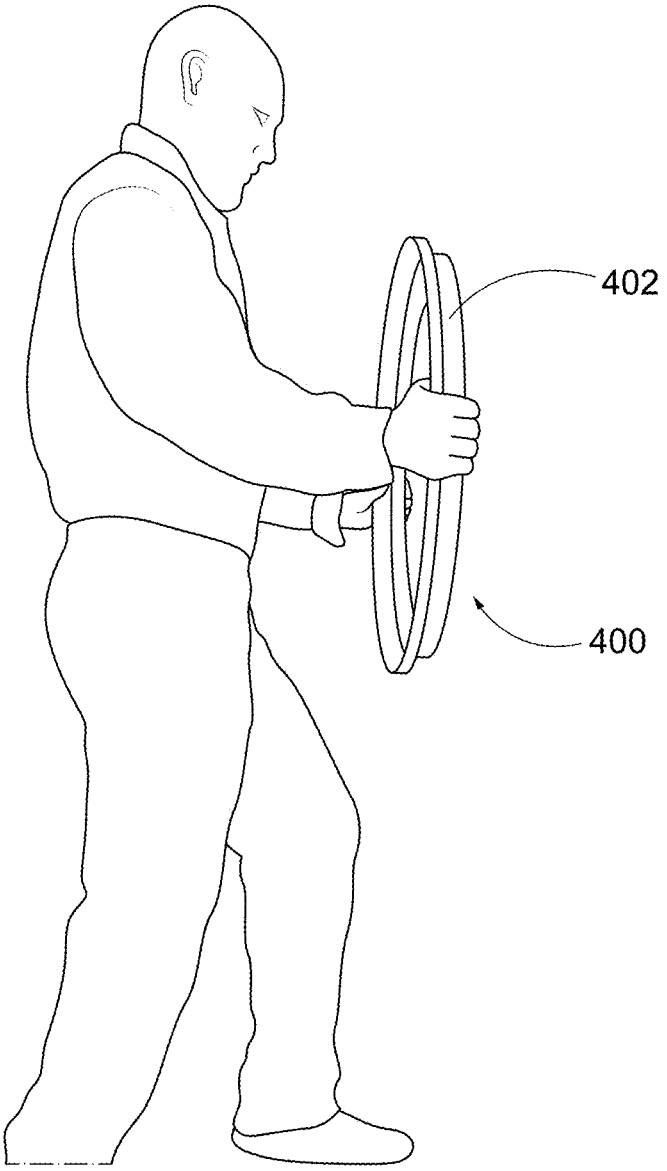
FIG. 27 is an image of a user exercising with the exercise and hydration device of FIG. 8 according to a third method.

FIG. 27 is an image of a user exercising with the exercise and hydration device 400 of FIG. 8 according to a third method. As shown, the user holds opposing sides of the tubular body 402 and holds the exercise and hydration device 400 in front of the user's body with his arms slightly bent (at a 90 degree angle or less). This position may strengthen the arms and shoulders, adding an upper body workout as the user walks or runs. The user may move the exercise and hydration device 400 closer and further from the user's body for an added strength workout. The user may extend the exercise and hydration device 400 farther from the user's core, which may increase the effectiveness of dynamic stretching. By bending the user's arms, the user may activate the user's arm muscles (e.g., biceps and triceps).

The above use examples are meant to be illustrations of how one or more disclosed exercise and hydration devices may be used during a cardio workout and other uses are contemplated. Further, the above described uses may be combined during a cardio workout to activate, strengthen, and/or stretch different upper body muscles. By carrying a disclosed exercise and hydration device in one or both of a user's hands and/or on one or both of a user's shoulders, the user activates the user's upper body during the cardio workout. Such upper body activation may include strength training and/or dynamic stretching. The user may extend the exercise and hydration device away from the user's core to increase the effectiveness of dynamic stretching and/or strength training. The user can drink the potable liquid out of the exercise and hydration device to hydrate as the user exercises. As the user drinks the potable liquid, the exercise and hydration device may decrease in weight, which may be desirable as the user exhausts energy throughout the workout.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the structures disclosed herein, and do not create limitations, particularly as to the position, orientation, or use of such structures. Connection references (e.g., attached, coupled, connected, and joined) are to be construed broadly and may include intermediate members between a collection of elements and relative movement between elements unless otherwise indicated and may include wired or wireless connections, including electrical connections. As such, connection references do not necessarily infer that two elements are directly connected and in fixed relation to each other. The exemplary drawings are for purposes of illustration only and the dimensions, positions, order, and relative sizes reflected in the drawings attached hereto may vary.

While certain orders of operations are provided for methods disclosed herein, it is contemplated that the operations may be performed in any order and that operations can be omitted, unless specified otherwise.

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

I claim:

1. An exercise and hydration device, comprising:

a single elongated tubular body extending from a first end of the exercise and hydration device to a second end of the exercise and hydration device, wherein the single elongated tubular body comprises a plurality of body segments removably coupled to one another along a longitudinal axis, and wherein the first end of the exercise and hydration device defines an aperture, and wherein a length of the exercise and hydration device is defined between the first end of the exercise and hydration device and the second end of the exercise and hydration device and a width of the exercise and hydration device is defined by a diameter of the aperture; and a cap coupled to the first end, the cap sealing the aperture;

wherein the single elongated tubular body and the cap together define an enclosed internal cavity that extends from the first end of the exercise and hydration device to the second end of the exercise and hydration device, and wherein the aperture provides access to the enclosed internal cavity;

wherein the enclosed internal cavity directly stores an amount of a potable liquid that adds a weight to the exercise and hydration device that is desirable for upper body strength training by a user of the exercise and hydration device.

2. The exercise and hydration device of claim 1, wherein the length is 80% to 110% of a user's height for improved stability during upper body strength training.

3. The exercise and hydration device of claim 1, wherein the length is approximately 6 feet.

4. The exercise and hydration device of claim 1, wherein the width is uniform along a majority of the length of the exercise and hydration device.

5. The exercise and hydration device of claim 1, wherein the width is approximately 1 inch.

6. The exercise and hydration device of claim 1, wherein the length is more than 20 times greater than the width.

7. The exercise and hydration device of claim 1, wherein the cap is configured to be popped off or snapped onto the first end to facilitate quick removal and reattachment of the cap and wherein the cap is coupled to the single elongated tubular body by an attachment that enables the cap to remain coupled to the single elongated tubular body by the attachment after the cap is removed from the first end.

8. The exercise and hydration device of claim 1, wherein the second end comprises a rubber base.

9. The exercise and hydration device of claim 1, further comprising a rubber grip positioned at a center of the single elongated tubular body to facilitate holding the exercise and hydration device at the center.

10. The exercise and hydration device of claim 1, wherein the amount of the potable liquid is between 25 to 32 ounces.

11. The exercise and hydration device of claim 1, wherein the cap is a screw cap that is coupled to the first end by threading.

12. The exercise and hydration device of claim 1, wherein the single elongated tubular body is insulated to maintain a temperature of the potable liquid when the potable liquid is stored inside the enclosed internal cavity.

13. A method of using an exercise and hydration device, comprising:

obtaining one or more exercise and hydration devices, wherein an exercise and hydration device of the one or more exercise and hydration devices comprises:

a single elongated tubular body defined between a first end and a second end of the exercise and hydration device, wherein the first end and the second end define a length of the exercise and hydration device therebetween, wherein the length is greater than 1 foot, an aperture defined by the single elongated tubular body at the first end, and a cap sealing the aperture, wherein the single elongated tubular body and the cap together define an enclosed internal cavity that extends from the first end to the second end of the exercise and hydration device;

removing the cap from the aperture such that the enclosed internal cavity forms an accessible cavity;

pouring a potable liquid through the aperture to at least partially fill the accessible cavity directly with the potable liquid; and moving with the one or more exercise and hydration devices directly in one or both of a user's hands to engage the user's upper body during a cardio exercise.

14. The method of claim 13, wherein the one or more exercise and hydration devices comprise two exercise and hydration devices, and wherein moving with the one or more exercise and hydration devices comprises:

hiking up a hill with the two exercise and hydration devices in both hands, and striking a ground surface with the second end of the exercise and hydration device, wherein the length is such that the user's hand and wrist are at greater than a 90 degree angle to the tubular body when the second end strikes the ground surface.

15. The method of claim 13, wherein the one or more exercise and hydration devices comprise two exercise and hydration devices, and wherein moving with the one or more exercise and hydration devices comprises running with the two exercise and hydration devices in both hands, and swinging the two exercise and hydration devices with arms bent to activate bicep muscles in each arm.

16. The method of claim 13, wherein moving with the one or more exercise and hydration devices comprises walking with the exercise and hydration device positioned behind the user's neck and on top of each of the user's shoulders.

17. The method of claim 13, wherein moving with the one or more exercise and hydration devices comprises walking or running with the exercise and hydration device in one hand at less than a 90 degree angle to the user's wrist.

18. The method of claim 13, wherein moving with the one or more exercise and hydration devices comprises extending the one or more exercise and hydration devices away from the user's body as the user walks or runs.

19. The method of claim 13, wherein moving with the one or more exercise and hydration devices comprises walking, running, or hiking.

20. The method of claim 13, further comprising drinking the potable liquid through the aperture.

* * * * *